US011892202B2

(12) United States Patent
Vaisman et al.

(10) Patent No.: US 11,892,202 B2
(45) Date of Patent: Feb. 6, 2024

(54) THERMAL MANAGEMENT SYSTEMS

(71) Applicant: Booz Allen Hamilton Inc., McLean, VA (US)

(72) Inventors: Igor Vaisman, Carmel, IN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 0 days.

(21) Appl. No.: 17/951,447

(22) Filed: Sep. 23, 2022

(65) Prior Publication Data

US 2023/0096113 A1 Mar. 30, 2023

Related U.S. Application Data

(60) Provisional application No. 63/287,613, filed on Dec. 9, 2021, provisional application No. 63/247,366, filed on Sep. 23, 2021.

(51) Int. Cl.
*F25B 1/10* (2006.01)

(52) U.S. Cl.
CPC ..... *F25B 1/10* (2013.01); *F25B 2400/13* (2013.01)

(58) Field of Classification Search
CPC .... F25B 1/10; F25B 2400/13; F25B 2400/16; F25B 2600/2523; F25B 2345/00; F25B 2345/001; F25B 2345/004; F25B 43/006; F25B 2313/001
See application file for complete search history.

(56) References Cited

U.S. PATENT DOCUMENTS

| | | | |
|---|---|---|---|
| 11,112,155 | B1 | 9/2021 | Vaisman et al. |
| 11,448,431 | B1 | 9/2022 | Davis et al. |
| 2005/0132729 | A1 | 6/2005 | Manole |

(Continued)

FOREIGN PATENT DOCUMENTS

| | | |
|---|---|---|
| JP | 2004308972 | 11/2004 |
| JP | 2018009630 | 1/2018 |

OTHER PUBLICATIONS

Chen et al., "A review study of solid-gas sublimation flow for refrigeration: From basic mechanism to applications," International Journal of Refrigeration, Apr. 2014, 40:61-83.

(Continued)

*Primary Examiner* — Miguel A Diaz
(74) *Attorney, Agent, or Firm* — Fish & Richardson P.C.

(57) ABSTRACT

Thermal management techniques include: transporting a refrigerant fluid from a receiver to an inlet of a flash tank that has a vapor-side outlet and liquid-side outlet such that a liquid phase of the refrigerant fluid moves to a bottom of the flash tank and outputs from the liquid-side outlet; forming a solid-vapor state from the liquid phase by expanding the liquid phase with an expansion valve to a first pressure that is less than a triple point pressure to form a solid-vapor mixture of the refrigerant fluid; extracting heat from a heat load with an evaporator that receives the solid-vapor mixture of the refrigerant fluid and sublimates the solid state of the solid-vapor mixture of the refrigerant fluid directly into a vapor phase of the refrigerant fluid; and discharging, from an exhaust line, the vapor phase to an ambient environment without returning the vapor phase to the receiver.

34 Claims, 10 Drawing Sheets

(56) References Cited

U.S. PATENT DOCUMENTS

| | | | | |
|---|---|---|---|---|
| 2014/0075984 | A1* | 3/2014 | Sugawara | B01D 53/0438 62/606 |
| 2015/0075636 | A1 | 3/2015 | Sugawara et al. | |
| 2018/0023805 | A1* | 1/2018 | Qin | B01D 5/0075 122/32 |
| 2018/0135896 | A1 | 5/2018 | Petersen et al. | |

OTHER PUBLICATIONS

EngineeringToolBox.com [online], "Refrigeration Formulas," 2010, retrieved on Nov. 7, 2022, retrieved from URL <https://www.engineeringtoolbox.com/refrigeration-formulas-d_1695.html>, 5 pages.
Hussmann.com [online], "CO2 Transcritical Systems Training Manual," Revision 1, Apr. 2018, retrieved on Nov. 7, 2022, retrieved from URL <https://www.hussmann.com/ns/Technical-Documents/CO2_Transcritical_Systems_Training_Manual 042718.pdf>, 42 pages.
International Search Report and Written Opinion in International Appln. No. PCT/US2022/044514, dated Jan. 3, 2023, 9 pages.

* cited by examiner

* *Diagram created using REFPROP - NIST reference fluid properties*

* Diagram created using REFPROP - NIST reference fluid properties

THERMAL MANAGEMENT SYSTEMS

CROSS-REFERENCE TO RELATED APPLICATIONS

This application claims priority under 35 U.S.C. § 119 to U.S. Provisional Patent Application Ser. No. 63/247,366, filed on Sep. 23, 2021, and U.S. Provisional Patent Application Ser. No. 63/287,613, filed on Dec. 9, 2021. The entire contents of both previous applications are incorporated by reference in their entirety herein.

BACKGROUND

Refrigeration systems absorb thermal energy from the heat sources and discharge thermal energy into the surrounding environment. Conventional closed-circuit refrigeration systems can include at least a compressor, a heat rejection exchanger (i.e., a condenser), a liquid refrigerant receiver, an expansion device, and a heat absorption exchanger (i.e., an evaporator). Such closed-circuit systems can be used to maintain operating temperature set points for a wide variety of cooled heat sources (loads, processes, equipment, systems) thermally interacting with the evaporator. Closed-circuit refrigeration systems may pump significant amounts of absorbed thermal energy from heat sources into the surrounding environment. However, condensers and compressors can be heavy and can consume relatively large amounts of power. In general, the larger the amount of absorbed thermal energy that the system is designed to handle, the heavier the refrigeration system and the larger the amount of power consumed during operation, even when cooling of a heat source occurs over relatively short time periods.

SUMMARY

This disclosure features thermal management systems that include open-circuit refrigeration systems (OCRSs), as well as thermal management systems that include closed-circuit refrigeration systems (CCRSs) integrated with OCRSs.

Open-circuit refrigeration systems can include a refrigerant receiver, an expansion device, and a heat absorption exchanger (i.e., an evaporator or cold plate). The receiver stores refrigerant which is used to cool heat loads. Refrigerant may be in gaseous state at a pressure above the critical pressure or in a liquid or two-phase state below the critical point depending on the refrigerant temperature in the receiver. Typically, the longer the desired period of operation of an open-circuit refrigeration system, the larger the receiver and the charge of refrigerant fluid contained within it. OCRSs are useful in many circumstances, including in systems where dimensional and/or weight constraints are such that heavy compressors and condensers typical of closed-circuit refrigeration systems are impractical, and/or power constraints make driving the components of closed-circuit refrigeration systems infeasible.

A typical OCRS uses ammonia as a refrigerant fluid. During operation of the OCRS, after being used for cooling a heat load, the ammonia is either discharged into an ambient, processed and then discharged or used as a fuel in an engine. One of the drawbacks of ammonia is the relative toxicity of ammonia making simple discharge of spent ammonia vapor problematic.

According to an aspect, a thermal management system includes an open-circuit refrigeration system that has an open-circuit refrigerant fluid flow path. The refrigerant fluid flow path includes a receiver configured to store a refrigerant fluid in a phase that is a sub-critical or a supercritical or a trans-critical phase, and that expands in volume below a corresponding triple point and sublimates at an exhaust pressure. The receiver has an inlet and an outlet. The system includes an expansion device that has an inlet coupled to the receiver outlet and an outlet, with the expansion valve configured to expand refrigerant from the receiver to an ambient pressure that is below the triple point pressure of the refrigerant fluid to turn the refrigerant into a solid state. The system includes an evaporator coupled to the outlet of the expansion valve. The evaporator is configured to receive the solid state of the refrigerant and to extract heat from a heat load that contacts or is in proximity to the evaporator to sublime the solid state of the refrigerant directly into a vapor state of the refrigerant. The system has an exhaust line coupled to an outlet of the evaporator. The exhaust line is configured to discharge the vapor state of the refrigerant into an ambient.

As noted, this disclosure features thermal management systems that include closed-circuit refrigeration systems that are integrated with open-circuit refrigeration systems, with a refrigerant that operates under sublimation conditions. Open-circuit refrigeration systems generally include a refrigerant receiver, an expansion device, and a heat absorption exchanger (i.e., an evaporator or cold plate). The receiver stores refrigerant which is used to cool heat loads. Refrigerant may be in gaseous state at a pressure above the critical pressure or in a liquid or two-phase state below the critical point depending on the refrigerant temperature in the receiver. Typically, the longer the desired period of operation of an open-circuit refrigeration system, the larger the receiver and the charge of refrigerant fluid contained within it. Open-circuit refrigeration systems are useful in many circumstances, including in systems where dimensional and/or weight constraints are such that heavy compressors and condensers typical of closed-circuit refrigeration systems are impractical, and/or power constraints make driving the components of closed-circuit refrigeration systems infeasible.

Aspects also include methods and computer program products to control thermal management system with an open-circuit refrigerant system. One or more of the above aspects may include amongst features described herein one or more of the following features.

Disclosed herein is an alternative type of refrigeration system that uses supercritical carbon dioxide ($CO_2$). The $CO_2$ refrigerant does not have the same disposal problems as ammonia. The $CO_2$ in the receiver exist in liquid state or in two-phase state at a pressure below the critical point or in a gaseous state at a pressure above the critical point. In the first case the OCRS operates in sub-critical mode. In the second case it operates in a trans-critical mode. The cold plate is configured to operate at a temperature below triple point and deals with sublimation, with or without superheat. The superheat can be very high since the exit temperature may approach close to the heat load temperature.

In an example implementation, a thermal management system (TMS) includes an open-circuit refrigeration system that includes an open-circuit refrigerant fluid flow path. The with the open-circuit refrigerant fluid flow path includes a receiver configured to store a refrigerant fluid in a refrigerant phase that is a sub-critical or super critical and that expands in volume below a corresponding triple point and sublimates at an exhaust pressure. The receiver includes an inlet and an outlet. The TMS includes an expansion valve that includes an inlet coupled to the outlet of the receiver and an outlet. The expansion valve is configured to expand the refrigerant fluid from the receiver to an ambient pressure that is below the triple point pressure of the refrigerant fluid to turn the refrigerant fluid into a solid state. The TMS includes an evaporator fluidly coupled to the outlet of the expansion valve. The evaporator is configured to receive the refrigerant fluid and to extract heat from at least one heat load that is in at least one of thermal conductive or convective contact or is in proximity to the evaporator to sublime the solid state of the refrigerant fluid directly into a vapor state of the refrigerant. The TMS includes an exhaust conduit fluidly coupled to an outlet of the evaporator and configured to discharge the vapor state of the refrigerant into an ambient environment.

In an aspect combinable with the example implementation, the phase is the supercritical phase that is above a liquid zone of a phase diagram for the refrigerant fluid.

In another aspect combinable with any of the previous aspects, the expansion valve is configured to control a temperature of the at least one heat load.

In another aspect combinable with any of the previous aspects, the expansion valve is fluidly coupled upstream from the exhaust conduit.

In another aspect combinable with any of the previous aspects, the refrigerant fluid is carbon dioxide.

In another aspect combinable with any of the previous aspects, the expansion valve is a mechanically or electronically controllable expansion valve.

Another aspect combinable with any of the previous aspects further includes a recuperative heat exchanger that has a first fluid path that receives the refrigerant fluid from the outlet of the receiver and delivers the refrigerant fluid to the inlet of the expansion valve, and a second fluid path that receives refrigerant fluid from the outlet of the evaporator and provides discharged refrigerant vapor into the exhaust conduit.

In another aspect combinable with any of the previous aspects, the recuperative heat exchanger is in at least one of thermal conductive or convective contact between the refrigerant fluid leaving the receiver and refrigerant vapor passed into the recuperative heat exchanger to cause heat from the refrigerant vapor to be transferred to the refrigerant fluid received from the receiver.

In another aspect combinable with any of the previous aspects, the heat transfer increases a refrigeration effect in the evaporator.

In another aspect combinable with any of the previous aspects, the heat transfer reduces a refrigerant mass transfer rate for the heat load, relative to a refrigerant mass transfer rate for the heat load without the recuperative heat exchanger for a given initial quantity of the refrigerant fluid introduced into the receiver.

Another aspect combinable with any of the previous aspects further includes a pressure control device configured to control a temperature of the at least one heat load.

In another aspect combinable with any of the previous aspects, the pressure control device is fluidly coupled between an outlet of the recuperative heat exchanger that is part of the second fluid path and an inlet to the exhaust conduit.

Another aspect combinable with any of the previous aspects further includes an external cooling system configured to deliver a coolant in thermal proximity with refrigerant fluid in the receiver.

In another aspect combinable with any of the previous aspects, the expansion valve is a fixed or variable orifice.

Another aspect combinable with any of the previous aspects further includes a second control device having an inlet disposed at the outlet of the evaporator and having an outlet disposed at an inlet to the exhaust line, with the second control device configured to control pressure of the vapor state of the refrigerant prior to discharge into the ambient.

In another aspect combinable with any of the previous aspects, the expansion valve the second control device is a back-pressure regulator.

In another example implementation, a thermal management method includes transporting a refrigerant fluid from a receiver through an expansion valve, an evaporator configured to extract heat from at least one heat load in at least one of thermal conductive or convective contact with the evaporator, and an exhaust conduit. The receiver stores the refrigerant fluid in a phase that is sub-critical or supercritical and that expands in volume below a corresponding triple point and sublimates at an exhaust pressure. The method further includes sublimating, in the evaporator, a solid state of the refrigerant fluid by extracting heat from the at least one heat load to produce a vapor state of the refrigerant fluid. The method further includes discharging, through the exhaust conduit, the vapor state of the refrigerant into an ambient environment An aspect combinable with the example implementation further includes expanding, with the expansion valve, the refrigerant fluid from the receiver into an ambient pressure that is below the triple point pressure of the refrigerant fluid to turn the refrigerant fluid into the solid state.

In another aspect combinable with any of the previous aspects, the phase is the supercritical phase state that is above a liquid zone of a phase diagram for the refrigerant fluid.

In another aspect combinable with any of the previous aspects, the refrigerant fluid is carbon dioxide.

In another aspect combinable with any of the previous aspects, the expansion valve is an electronically controllable expansion valve.

Another aspect combinable with any of the previous aspects further includes transferring heat from the refrigerant fluid in the solid state from the evaporator to a discharged refrigerant vapor in the exhaust line by a recuperative heat exchanger that has a first fluid path that receives the refrigerant fluid from the outlet of the receiver and delivers the refrigerant fluid to the inlet of the expansion valve, and a second fluid path that receives discharged refrigerant vapor from the outlet of the evaporator and provides the discharged refrigerant vapor into the exhaust conduit.

In another aspect combinable with any of the previous aspects, the heat transfer increases a refrigeration effect in the evaporator.

In another aspect combinable with any of the previous aspects, the heat transfer reduces a refrigerant mass transfer rate for the heat load, relative to a refrigerant mass transfer rate for the heat load without the recuperative heat exchanger for a given initial quantity of refrigerant fluid introduced into refrigerant receiver.

Another aspect combinable with any of the previous aspects further includes controlling a pressure of the vapor state of the refrigerant fluid prior to discharge into the ambient environment with a pressure control device.

In another aspect combinable with any of the previous aspects, the pressure control device is a back-pressure regulator.

In another example implementation, a thermal management system includes a receiver that includes an inlet and an outlet. The receiver is configured to store a refrigerant fluid at a first pressure that is a greater than a critical point pressure of the refrigerant fluid. The system includes at least one flash tank that includes an inlet fluidly coupled to the outlet of the receiver, a vapor-side outlet, and a liquid-side outlet. The system includes an expansion valve that includes an inlet fluidly coupled to the outlet of the flash tank. The expansion valve is configured to expand the refrigerant fluid from the flash tank to a second pressure that is less than a triple point pressure of the refrigerant fluid to form a solid-vapor mixture of the refrigerant fluid. The system includes an evaporator including an inlet positioned to receive the solid-vapor mixture of the refrigerant fluid and configured to extract heat from at least one heat load that is in at least one of thermal conductive or convective contact or is in proximity to the evaporator. The evaporator is further configured to sublimate a solid state of the solid-vapor mixture of the refrigerant fluid directly into a vapor state of the refrigerant fluid. The system includes an exhaust conduit fluidly coupled to an outlet of the evaporator, the exhaust conduit configured to discharge the vapor state of the refrigerant fluid into an ambient environment without returning the vapor state of the refrigerant fluid from the outlet of the evaporator to the receiver.

In an aspect combinable with the example implementation, the refrigerant fluid is in a sub-critical or a supercritical phase, and the refrigerant fluid expands in volume below a corresponding triple point and sublimates at an exhaust pressure.

In another aspect combinable with any of the previous aspects, the refrigerant fluid is carbon dioxide.

In another aspect combinable with any of the previous aspects, the expansion valve is a mechanically or electronically controllable expansion valve.

In another aspect combinable with any of the previous aspects, the expansion valve is a fixed or variable orifice.

In another aspect combinable with any of the previous aspects, the flash tank is configured to reduce a refrigerant fluid enthalpy at the inlet to the evaporator to increase a refrigeration effect of the refrigerant fluid in the evaporator.

In another aspect combinable with any of the previous aspects, the expansion valve is a first expansion valve.

Another aspect combinable with any of the previous aspects further includes a second expansion valve that includes an inlet and an outlet. The inlet is fluidly coupled to the outlet of the receiver. The second expansion valve is configured to expand the refrigerant fluid from the receiver into a liquid-vapor mixture at a third pressure that is between the first pressure and the second pressure.

In another aspect combinable with any of the previous aspects, the flash tank is configured to receive the liquid-vapor mixture of the refrigerant fluid and store the liquid-vapor mixture at the third pressure.

Another aspect combinable with any of the previous aspects further includes an open-circuit refrigeration system that includes the receiver, the first and the second expansion valves, the flash tank, the evaporator, and the exhaust conduit.

Another aspect combinable with any of the previous aspects further includes a closed-circuit refrigeration system included of the flash tank, the closed-circuit refrigeration system configured to receive the refrigerant fluid from the flash tank.

In another aspect combinable with any of the previous aspects, the closed-circuit refrigeration system further includes a compressor including an inlet and an outlet, the inlet of the compressor fluidly coupled to the vapor-side outlet of the flash tank. The compressor is configured to compress refrigerant vapor that exits from the vapor-side outlet of the flash tank.

In another aspect combinable with any of the previous aspects, the expansion valve is a first expansion valve, and the closed-circuit refrigeration system further includes a heat rejection exchanger including an inlet and an outlet, the inlet of the heat rejection exchanger fluidly coupled to the outlet of the compressor; and a second expansion valve having an inlet and an outlet. The inlet of the second expansion valve is fluidly coupled to the outlet of the heat rejection exchanger. The outlet of the second expansion valve is fluidly coupled to the inlet of the flash tank. The second expansion valve is configured to expand refrigerant fluid from the flash tank to a third pressure that is between the first pressure and the second pressure.

In another aspect combinable with any of the previous aspects, a compressor discharge pressure from the compressor is a trans-critical discharge pressure and the heat rejection exchanger is a gas cooler.

In another aspect combinable with any of the previous aspects, a compressor discharge pressure from the compressor is a sub-critical discharge pressure and the heat rejection exchanger is a condenser.

Another aspect combinable with any of the previous aspects further includes Another aspect combinable with any of the previous aspects further includes a recuperative heat exchanger that includes a first fluid path that receives the refrigerant fluid from the outlet of the flash tank and delivers the refrigerant fluid to the inlet of the compressor; and a second fluid path that receives refrigerant from the outlet of the heat rejection exchanger and provides expanded refrigerant vapor to the inlet of the flash tank.

In another aspect combinable with any of the previous aspects, the recuperative heat exchanger is configured to provide thermal contact between the refrigerant vapor leaving the flash tank and refrigerant vapor passed into the recuperative heat exchanger to cause heat from the refrigerant vapor to be transferred to the refrigerant fluid received from the heat rejection exchanger.

In another aspect combinable with any of the previous aspects, the flash tank is configured to reduce a refrigerant fluid enthalpy at the inlet to the evaporator to increase a refrigeration effect of refrigerant fluid in the evaporator.

Another aspect combinable with any of the previous aspects further includes a cooling system configured to cool the refrigerant fluid at the receiver.

Another aspect combinable with any of the previous aspects further includes an external cooling system configured to deliver a coolant in thermal proximity with the refrigerant fluid that leaves the outlet of the receiver.

Another aspect combinable with any of the previous aspects further includes a second heat rejection exchanger that includes an inlet and an outlet.

Another aspect combinable with any of the previous aspects further includes a second flash tank that includes an inlet, a vapor-side outlet, and a liquid-side outlet. The inlet of the second flash tank is configured to receive refrigerant fluid from the outlet of the second expansion valve.

Another aspect combinable with any of the previous aspects further includes a second compressor that includes an inlet and an outlet. The inlet of the second compressor is fluidly coupled to the liquid-side outlet of the second flash tank, and the outlet of the second compressor is fluidly coupled to the inlet of the second heat rejection exchanger.

In another aspect combinable with any of the previous aspects, the outlet of the second heat rejection exchanger is coupled to the inlet of the first heat rejection exchanger, and the inlet of the second compressor is coupled to the liquid-side outlet of the second flash tank.

Another aspect combinable with any of the previous aspects further includes a third expansion valve that includes an inlet and an outlet.

Another aspect combinable with any of the previous aspects further includes a second recuperative heat exchanger that includes a first fluid path configured to receive the refrigerant fluid from the outlet of the first flash tank and deliver the refrigerant fluid to the inlet of the third expansion valve, and a second fluid path configured to receive refrigerant from the vapor-side outlet of the second flash tank and provide the refrigerant vapor to the inlet of the second compressor.

Another aspect combinable with any of the previous aspects further includes a fourth expansion valve that includes an inlet and an outlet. The inlet of the fourth expansion valve is fluidly coupled to the outlet of the receiver, the outlet of the fourth expansion valve fluidly coupled to the inlet of the first flash tank.

In another example implementation, a thermal management method includes transporting a refrigerant fluid from a receiver to an inlet of a flash tank that has a vapor-side outlet and liquid-side outlet such that a liquid phase of the refrigerant fluid moves to a bottom of the flash tank and outputs from the liquid-side outlet; forming a solid-vapor state from the liquid phase by expanding the liquid phase from the liquid-side outlet with an expansion valve to a first pressure that is less than a triple point pressure of the refrigerant fluid to form a solid-vapor mixture of the refrigerant fluid; extracting heat from a heat load in at least one of thermal conductive or convective contact or in proximity to an evaporator that receives the solid-vapor mixture of the refrigerant fluid and sublimates the solid state of the solid-vapor mixture of the refrigerant fluid directly into a vapor phase of the refrigerant fluid; and discharging, from an exhaust line fluidly coupled to an outlet of the evaporator, the vapor phase to an ambient environment without returning the vapor phase to the receiver.

In an aspect combinable with the example implementation, the refrigerant fluid is in a sub-critical or a supercritical phase.

In another aspect combinable with any of the previous aspects, the refrigerant fluid expands in volume below a corresponding triple point and sublimates at an exhaust pressure.

In another aspect combinable with any of the previous aspects, the refrigerant fluid is carbon dioxide.

In another aspect combinable with any of the previous aspects, the expansion device is a mechanically or electronically controllable expansion valve.

In another aspect combinable with any of the previous aspects, the expansion device is a fixed or variable orifice.

Another aspect combinable with any of the previous aspects further includes reducing, with the flash tank, a refrigerant fluid enthalpy at the inlet to the evaporator to increase a refrigeration effect of refrigerant fluid in the evaporator.

In another aspect combinable with any of the previous aspects, the expansion valve is a first expansion valve.

Another aspect combinable with any of the previous aspects further includes expanding the refrigerant fluid from the receiver into a liquid-vapor mixture to a third pressure that is between the first pressure and the second pressure with a second expansion valve that includes an inlet and an outlet. The inlet of the second expansion valve is fluidly coupled to the outlet of the receiver.

In another aspect combinable with any of the previous aspects, the flash tank receives the liquid-vapor mixture of the refrigerant fluid and stores the liquid-vapor mixture at the third pressure, the receiver, the first and the second expansion valves, the flash tank, the evaporator, and the exhaust conduit fluidly coupled to form an open-circuit refrigeration system.

Another aspect combinable with any of the previous aspects further includes discharging refrigerant vapor from the exhaust conduit to the ambient environment without returning the discharged refrigerant vapor to the receiver.

Another aspect combinable with any of the previous aspects further includes receiving refrigerant fluid in a closed-circuit refrigeration system from the flash tank; and compressing vapor from the vapor-side outlet of the flash tank by a compressor having an inlet and an outlet, with the inlet of the compressor fluidly coupled to the vapor-side outlet of the flash tank.

Another aspect combinable with any of the previous aspects further includes rejecting heat to the ambient environment with a heat rejection exchanger that includes an inlet and an outlet, the inlet of the heat rejection exchanger fluidly coupled to the outlet of the compressor; and expanding refrigerant fluid from the flash tank to a third pressure that is between the first pressure and the second pressure by a second expansion valve that comprises an inlet and an outlet, the inlet of the second expansion valve fluidly coupled to the outlet of the heat rejection exchanger. The outlet of the second expansion valve is fluidly coupled to the inlet of the flash tank.

In another aspect combinable with any of the previous aspects, a compressor discharge pressure from the compressor is a trans-critical discharge pressure, and the heat rejection exchanger is a gas cooler.

In another aspect combinable with any of the previous aspects, a compressor discharge pressure from the compressor is a sub-critical discharge pressure, and the heat rejection exchanger is a condenser.

Another aspect combinable with any of the previous aspects further includes causing heat from the refrigerant vapor to be transferred to the refrigerant fluid received from the heat rejection exchanger by a recuperative heat exchanger that has a first fluid path that receives the refrigerant fluid from the outlet of the flash tank and delivers the refrigerant to the inlet of the compressor, and a second fluid path that receives refrigerant from the outlet of the heat rejection exchanger and provides expanded refrigerant vapor into the flash tank.

The details of one or more embodiments are set forth in the accompanying drawings and the description below. Other features and advantages will be apparent from the description, drawings, and claims.

DETAILED DESCRIPTION

Figure 1:
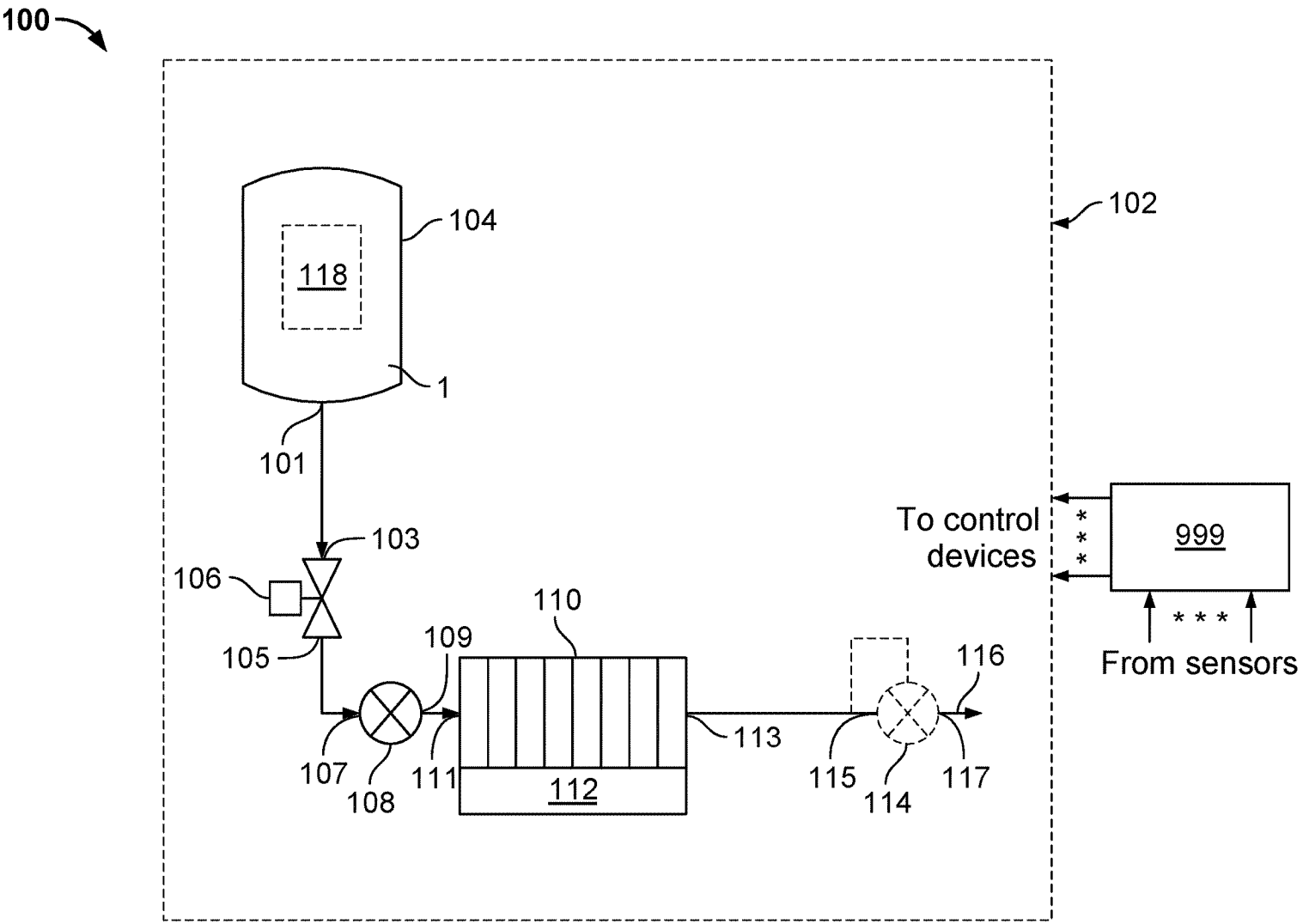
FIG. 1 is a schematic diagram of an example implementation of a thermal management system that includes an open-circuit refrigeration system (OCRS) that operates with one or more evaporators that provides sublimation of $CO_2$ refrigerant according to the present disclosure.

Cooling of high heat loads that are also highly temperature sensitive can present several challenges. On one hand, such loads generate significant quantities of heat that is extracted during cooling. In conventional closed-cycle refrigeration systems, cooling high heat loads typically involves circulating refrigerant fluid at a relatively high mass flow rate. However, closed-cycle system components that are used for refrigerant fluid circulation—including compressors and condensers—are typically heavy and consume significant power. As a result, many closed-cycle systems are not well suited for deployment in mobile platforms—such as on small vehicles—where size and weight constraints may make the use of large compressors and condensers impractical.

On the other hand, temperature sensitive loads such as electronic components and devices may require temperature regulation within a relatively narrow range of operating temperatures. Maintaining the temperature of such a load to within a small tolerance of a temperature set point can be challenging when a single-phase refrigerant fluid is used for heat extraction, since the refrigerant fluid itself will increase in temperature as heat is absorbed from the load.

Directed energy systems that are mounted to mobile vehicles such as trucks may present many of the foregoing operating challenges, as such systems may include high heat loads, temperature sensitive components that require precise cooling during operation in a relatively short time. The thermal management systems disclosed herein, while generally applicable to the cooling of a wide variety of thermal loads, are particularly well suited for operation with such directed energy systems.

One approach for dealing with such applications uses an open-circuit refrigeration system that includes ammonia as the refrigerant. As defined herein an open-circuit refrigeration system is a system that discharges refrigerant vapor such that the discharged refrigerant vapor is not returned to a receiver that is part of the open-circuit refrigeration system.

Discharged ammonia can be handled in several ways. Depending upon the nature of the refrigerant fluid, discharged refrigerant fluid, such as ammonia, may be incinerated as fuel, chemically treated, and/or simply discharged at the end of the flow path. However, in some examples discharge of ammonia into an ambient is not desirable or possible, e.g., due to regulatory or other requirements. In addition, it may not be feasible to incinerate or chemically treat the ammonia.

In particular, the thermal management systems and methods disclosed herein include several features that reduce both overall size and weight relative to conventional refrigeration systems. The disclosed systems and methods extract excess heat energy from both highly temperature sensitive components and relatively temperature insensitive components. This allows the system and methods to accurately match temperature set points for the components, and safely discharge refrigerant vapor.

In some aspects, "refrigeration" as used in the present disclosure can mean a system (or multiple systems fluidly coupled) that operates to generate a purposeful change of a characteristic of a coolant (e.g., a refrigerant fluid) to effectuate or increase heat transfer between two mediums (one of which can be the coolant). The purposeful change of the characteristic can be, for example, a change in pressure (e.g., depressurization) of a pressurized coolant though an expansion valve. In some embodiments, the change in pressure can include a phase change of the coolant, such as a liquid-to-gas phase change (e.g., endothermic vaporization). In some embodiments, pressurization of the refrigerant can be performed by a powered (e.g., electrically or otherwise) component, such as (but not limited to) a compressor. In some embodiments, pressurization can be performed as part of the refrigeration cycle (e.g., a closed-cycle refrigeration process in which gaseous refrigerant is substantially or completely recycled and compressed into a liquid state) or prior to use (e.g., storing pre-compressed liquid refrigerant for later use in an open-cycle refrigeration process in which a reserve of liquid refrigerant is used but substantially not recycled).

In some aspects, an OCRS includes one or more features that is distinct from a closed circuit, conventional refrigeration system (i.e., a closed circuit refrigeration system that is not integrated with an OCRS). For example, in some example aspects of an OCRS, a refrigerant fluid leaves the circuit after passing through an evaporator or a pressure control device (e.g., a back pressure regulator), into an exhaust conduit, and then into an ambient environment, without returning to the circuit. In some example aspects of an OCRS, a refrigerant fluid leaves the circuit not in response to an over pressure situation, such as through a pressure relief valve that opens when a pressure in a pressure vessel exceeds a threshold amount, but in a normal refrigeration operation. For instance, in a conventional closed circuit refrigeration system that includes a pressure relief valve connected to a condenser (or other pressure vessel), a release of overpressure by such valve may reduce a high-side pressure, which in turn may reduce the pressure differential across an expansion valve and reduce a corresponding refrigeration capacity at the expansion valve (rather than, of course, provide refrigeration capacity). In some example aspects of an OCRS that is not integrated with a CCRS, the OCRS does not include a heat exchanger in the form of a condenser in which a refrigerant fluid experiences a change of state from gas to liquid (or a mixed phase fluid) due to a cooling medium, or a heat exchanged in the form of a gas cooler in which a refrigerant fluid experiences a reduction in temperature without a change of phase.

Figure 2:
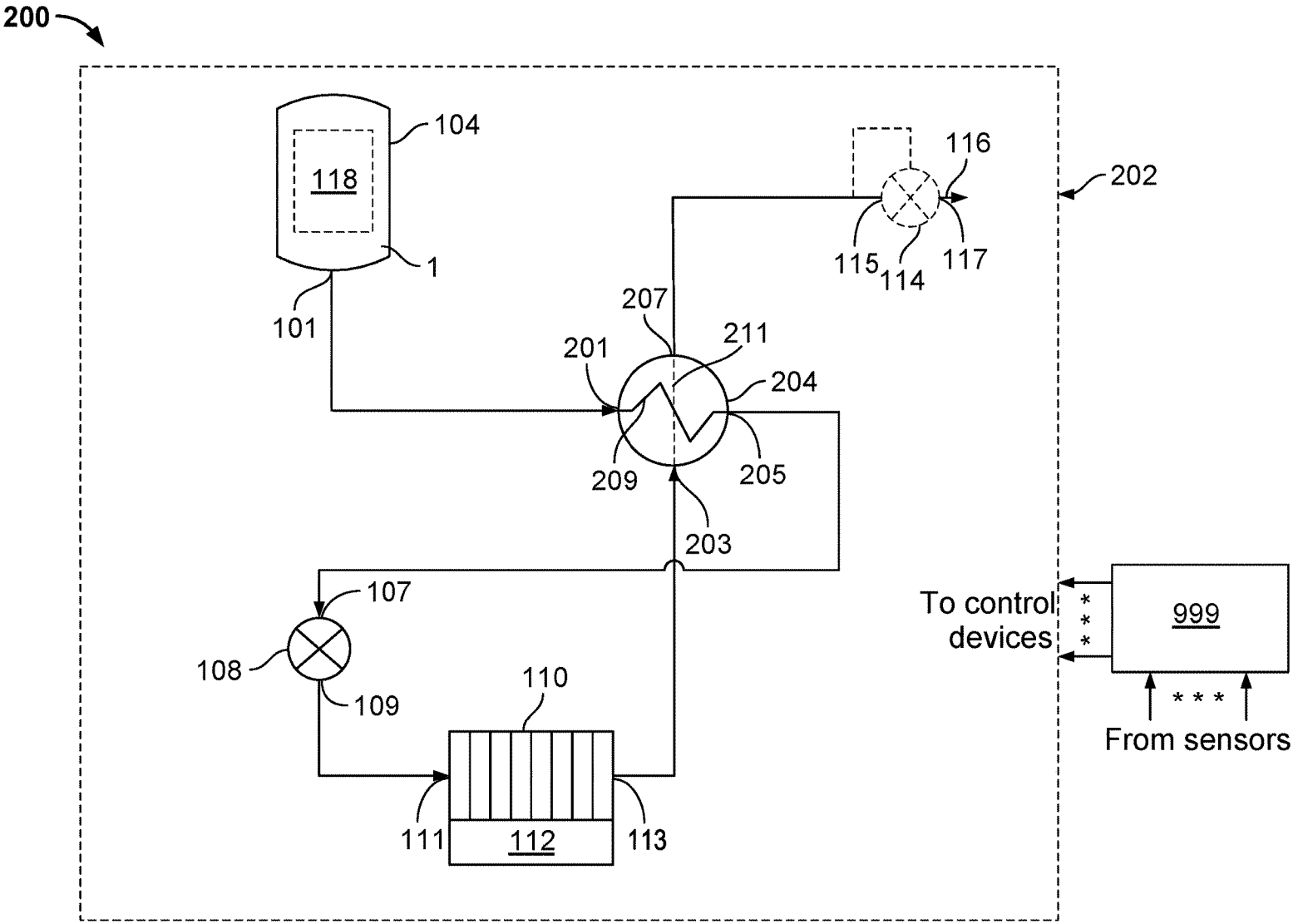
FIG. 2 is a schematic diagram of another example implementation of a thermal management system that includes an open-circuit refrigeration system that operates with one or more evaporators that provides sublimation of $CO_2$ refrigerant according to the present disclosure.

FIGS. 1 and 2 illustrate example implementations of thermal management systems that include an OCRS that uses carbon dioxide as the refrigerant fluid (i.e., a $CO_2$ OCRS). In particular, the OCRS shown in the example implementations uses sublimation of $CO_2$. The spent $CO_2$ can be safely discharged to an ambient environment, relative to other refrigerants such as ammonia. Thus, a $CO_2$ OCRS may require no significant power to sustain operation. In contrast to conventional refrigeration systems that use only closed-circuit refrigerant flow paths, the systems and methods disclosed herein use open-circuit refrigerant flow paths or closed-circuit refrigerant flow paths integrated with open-circuit refrigerant flow paths, with carbon dioxide as the refrigerant that operates under sublimation conditions.

In example thermal management systems disclosed in FIGS. 1 and 2, a receiver is initially charged with a refrigerant fluid that is in a liquid state. One example is supercritical carbon dioxide stored in the receiver. During operation of the $CO_2$ OCRS, the supercritical $CO_2$ is transported from the receiver through an expansion valve that expands the $CO_2$ to an ambient pressure of 104.7 pounds per square inch, absolute (psia), which is below the triple point pressure 75.4 psia. At this condition the high-pressure $CO_2$ turns into a dry ice state, which is a solid-vapor mixture. The dry ice in one or more evaporators (e.g., one or more cold plates) is used to cool an applied heat load causing the dry ice to sublimate into a vapor that is discharged from the exhaust line in the open-circuit refrigerant flow path.

Referring now to FIG. 1, an example implementation of a thermal management system (TMS) 100 that includes an open-circuit refrigeration system (OCRS) 102 is shown. In some aspects, OCRS 102 utilizes $CO_2$ as a refrigerant fluid 1; thus, the OCRS 102 can be implemented as a $CO_2$ OCRS 102. The $CO_2$ OCRS 102 includes a receiver 104 having an outlet 101 that is configured to store the refrigerant fluid 1. $CO_2$ OCRS 102 also includes an optional solenoid control valve 106 having an inlet 103 and an outlet 105. $CO_2$ OCRS 102 also includes a flow control device 108, such as an expansion valve 108, that includes an inlet 107 and an outlet 109. $CO_2$ OCRS 102 also includes one or more evaporators 110 (one shown) that is in thermally conductive and/or convective contact with one or more heat loads 112 (one shown). Evaporator 110 (also called cold plate 110) includes an inlet 111 and an outlet 113 for which the refrigerant fluid 1 to flow therethough. An optional pressure control device 114, such as a back pressure regulator 114, is fluidly coupled to the outlet 113 of the evaporator 110 at an inlet 115 of the device 114. The device 114 includes an outlet 117 that is coupled to an exhaust conduit 116. Exhaust conduit 116 is open to an ambient environment and not fluidly coupled back to any component of the $CO_2$ OCRS 102 opposite the outlet 117 of the pressure control device 114. As shown in FIG. 1, the components of the $CO_2$ OCRS 102 are fluidly coupled by conduits so that an outlet of one component is fluidly coupled to an inlet of another component (and so on).

Figure 9A:
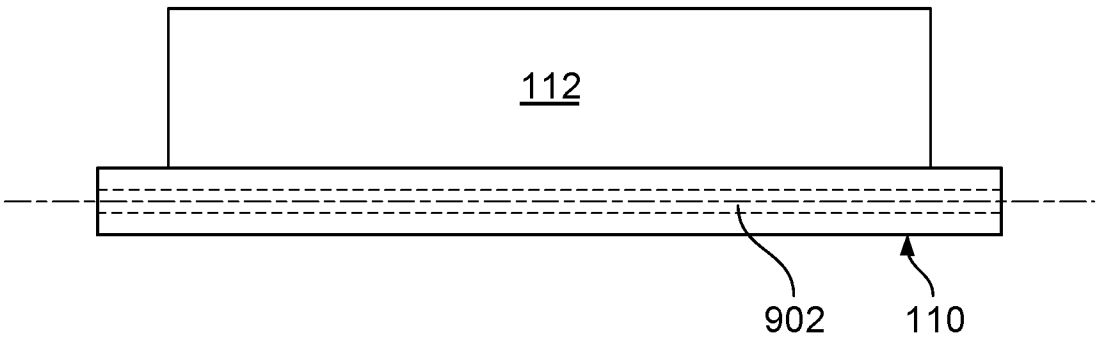
FIGS. 9A-9B are schematic diagrams of an example implementation of a thermal load that includes a cold plate having refrigerant fluid channels according to the present disclosure.
Figure 9B:
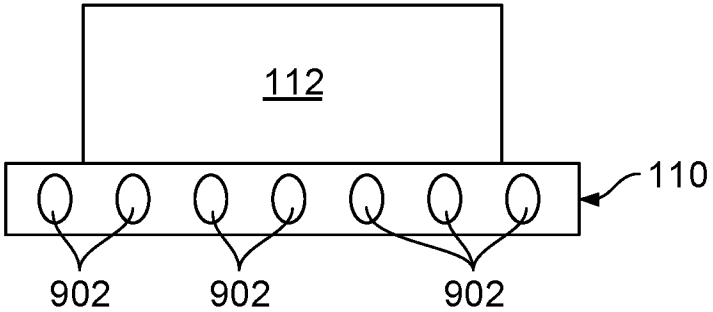

Turning briefly to FIGS. 9A-9B, these figures show an example implementation of a thermal load (heat load(s) 112) that includes a cold plate (evaporator or cold plate 110) having refrigerant fluid channels. For example, FIGS. 9A and 9B show side and end views, respectively, of heat load 112 with one or more integrated refrigerant fluid channels 902. The portion of heat load 112 with the refrigerant fluid channel(s) 902 effectively functions as a cold plate 110 for the TMS 100.

Cold plates 110 can be implemented in a variety of ways. Cold plate 110 (acting as evaporator 110) functions as a heat exchanger, providing thermal contact (conductive and/or convective) between the refrigerant fluid 1 and the heat load 112. Any cold plate may be used in the open-circuit refrigeration systems disclosed herein. Cold plates 110 can accommodate any refrigerant fluid channels (including mini/micro-channel tubes), blocks of printed circuit heat exchanging structures, or more generally, any heat exchanging structures that are used to transport single-phase or two-phase fluids. The fluid transport channels 902 can be attached to the heat load mechanically, or can be welded, brazed, or bonded to the heat load in any manner. In some embodiments, cold plates 110 (or certain components thereof) can be fabricated as part of heat load 112 or otherwise integrated into heat load 112.

In this example implementation, the expansion valve 108 can be alternatively a fixed or variable orifice or a controllable expansion valve. The optional solenoid control valve 106 may be employed when the expansion valve 108 cannot fully close a refrigerant fluid path from the receiver 104 to the evaporator 110 when the $CO_2$ OCRS 102 is in an off state.

Expansion valve 108 functions as a flow control device that enthalpically expands the refrigerant fluid 1 (here, in this example, $CO_2$) from a first pressure to a second, lower pressure. The expansion valve 108 can be a mechanical expansion valve. Mechanical expansion valves include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb, transfers the pressure in the bulb through the chamber to the diaphragm, and moves the diaphragm and the seat to close or to open the orifice.

The expansion valve 108 can be an electrical expansion valve. Typical electrical expansion valves include an orifice, a moving seat, a motor or actuator that changes the position of the seat with respect to the orifice, a controller (such as control system 999), and pressure and temperature sensors at the evaporator exit. A controller calculates the superheat for the expanded refrigerant fluid 1 based on pressure and temperature measurements at the outlet 113 of the evaporator 110. If the superheat is above a set-point value, the seat moves to increase the cross-sectional area and the refrigerant fluid volume and mass flow rates to match the superheat set-point value. If the superheat is below the set-point value the seat moves to decrease the cross-sectional area and the refrigerant fluid flow rates. Examples of suitable commercially available expansion devices (e.g., expansion valves 108) that can function as the first control device include, but are not limited to, thermostatic expansion valves available from the Sporlan Division of Parker Hannifin Corporation (Washington, MO) and from Danfoss (Syddanmark, Denmark).

The $CO_2$ OCRS 102 is operable to produce a solid-vapor phase that sublimates to a vapor, without first melting into a liquid. One suitable example of the refrigerant fluid 1 is carbon dioxide ($CO_2$). Initially, the refrigerant fluid 1 stored in the receiver 104 can be at a pressure above or below the critical point of the refrigerant fluid 1. In the case where the refrigerant fluid 1 is stored in the receiver 104, and starts at a pressure above the critical point and an end pressure ends below the critical point, then the OCRS 102 operates as a trans-critical OCRS; otherwise, if the end pressure ends still above the critical point, then the OCRS 102 operates as a super-critical OCRS. If the initial pressure is below the critical point, then the OCRS 102 operates as a sub-critical OCRS. In all cases, the refrigerant fluid 1 expands in volume below a corresponding triple point and sublimates at an exhaust pressure.

Referring back to FIG. 1, $CO_2$ in the receiver 104 is initially in a supercritical state, preferably, above a liquid zone (as explained in more detail with reference to FIG. 3.) The supercritical $CO_2$ refrigerant 1 is thus at a pressure above the critical pressure of 1060 psia at ambient temperature above 31° C. The supercritical $CO_2$ is enthalpically expanded in the expansion valve 108 to an ambient pressure at or below 104.7 psia, which is below the triple point pressure (75.4 psia). At this condition the high-pressure $CO_2$ turns into a dry ice state, i.e., a solid-vapor mixture. The dry ice solid-vapor mixture forms in evaporator 110 and is used to cool heat load(s) 112 attached to the evaporator 110. As heat is drawn away from the heat loads 112 thermally coupled to the evaporator 110, the dry ice sublimates (transitions from solid or solid-vapor mixture directly to vapor, without going through a liquid state at a constant sublimation temperature until it reaches the saturation state). Then the $CO_2$ vapor heats up to a temperature that approaches a temperature of the heat load(s) 112. The resulting $CO_2$ vapor is exhausted to an ambient environment through the exhaust line 116.

Figure 8:
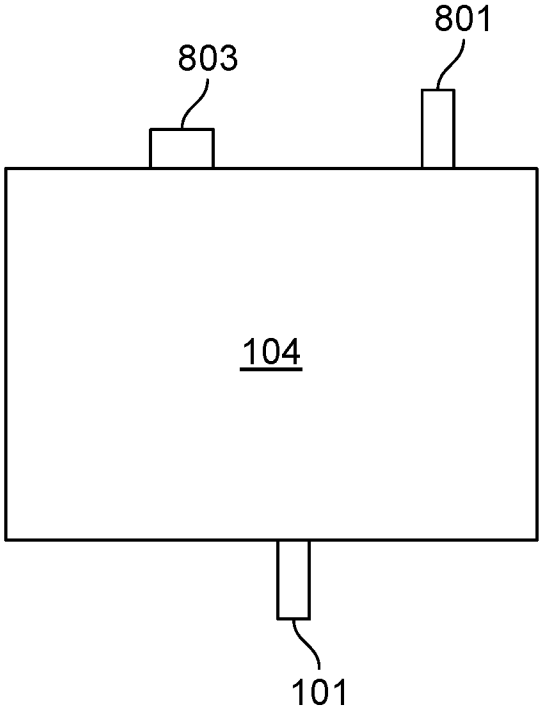
FIG. 8 is a schematic diagram of an example implementation of a receiver for refrigerant fluid in a thermal management system.

Turning briefly to FIG. 8, this figure shows an example implementation of the receiver 104 for refrigerant fluid 1 as used in an OCRS (such as $CO_2$ OCRS 102 or other OCRS described herein). Receiver 104 includes an inlet port 801, the outlet 101, and a pressure relief valve 803. To charge receiver 104, refrigerant fluid 1 is typically introduced into the receiver 104 via inlet port 801, and this can be done, for example, at service locations. Operating in the field, the refrigerant fluid exits receiver 104 through outlet 101, which is connected to a conduit network (as shown in FIG. 1). In case of emergency operation (rather than, normal OCRS operation in which refrigerant fluid 1 is exhausted to an ambient environment after providing cooling or refrigeration), if the pressure within receiver 104 exceeds a pressure limit value, pressure relief valve 803 opens to allow a portion of the refrigerant fluid 1 to escape through valve 803 to reduce the pressure within receiver 104. Receiver 104 can also include insulation (not shown in FIG. 8) applied around a receiver exterior surface. In general, receiver 104 can have a variety of different shapes. In some embodiments, for example, the receiver 104 is cylindrical. Examples of other possible shapes include, but are not limited to, rectangular prismatic, cubic, and conical. In certain embodiments, receiver 104 can be oriented such that outlet 101 is positioned at a bottom (with respect to gravity) of the receiver 104. In this manner, the liquid portion of the refrigerant fluid 1 within receiver 104 is discharged first through outlet 101.

As shown in FIG. 1, an optional pressure control device 114 is fluidly coupled within exhaust conduit 116 downstream of the evaporator 110 and can be controlled (e.g., by control system 999) to control upstream fluid pressure for some types of refrigerant fluid 1. In the $CO_2$-OCRS 102, the pressure control device 114 is not required and therefore optional However, for other types or refrigerant or if maintaining sublimation/pressure higher that the ambient pressure, the pressure control device 114 can be used to control the refrigerant fluid pressure upstream from the outlet 113 of the evaporator 110. The pressure control device 114 can be used to keep the sublimation/pressure higher that the ambient pressure. The pressure control device 114 can be implemented using a variety of different mechanical and electronic devices.

Typically, for example, the pressure control device 114 can be implemented as a flow regulation device, such as a back-pressure regulator. A back-pressure regulator (BPR) is a device that regulates fluid pressure upstream of the back-pressure regulator 114. In general, a wide range of different mechanical and electrical/electronic devices can be used as pressure control device 114. Typically, mechanical back-pressure regulating devices have an orifice and a spring supporting the moving seat against the pressure of the refrigerant fluid stream. The moving seat adjusts the cross-sectional area of the orifice and the refrigerant fluid volume and mass flow rates. Typical electrical back-pressure regulators include an orifice, a moving seat, a motor or actuator that changes the position of the seat in respect to the orifice, a controller (e.g., control system 999), and a pressure sensor at the evaporator exit or at the valve inlet. If the refrigerant fluid pressure is above a set-point value, the seat moves to increase the cross-sectional area of the orifice and the refrigerant fluid volume and mass flow rates to re-establish the set-point pressure value. If the refrigerant fluid pressure is below the set-point value, the seat moves to decrease the cross-sectional area and the refrigerant fluid flow rates.

Pressure control device 114 (as a back pressure regulator) can be selected based on the refrigerant fluid volume flow rate, the pressure differential across the regulator, and the pressure and temperature at the regulator inlet. Examples of suitable commercially available back-pressure regulators include, but are not limited to, valves available from the Sporlan Division of Parker Hannifin Corporation (Washington, MO) and from Danfoss (Syddanmark, Denmark).

Pressure control device 114 (as a back pressure regulator) can be used with all of the embodiments discussed herein in FIGS. 1, 2, 4, and 5 (even if not expressly shown in each figure). If there is a need to keep the sublimation pressure lower than the ambient pressure, a compressor (e.g., in the exhaust conduit 116) may be used instead of the pressure control device 114. The compressor can compress refrigerant and exhaust it into an ambient environment through exhaust conduit 116.

Figure 7B:
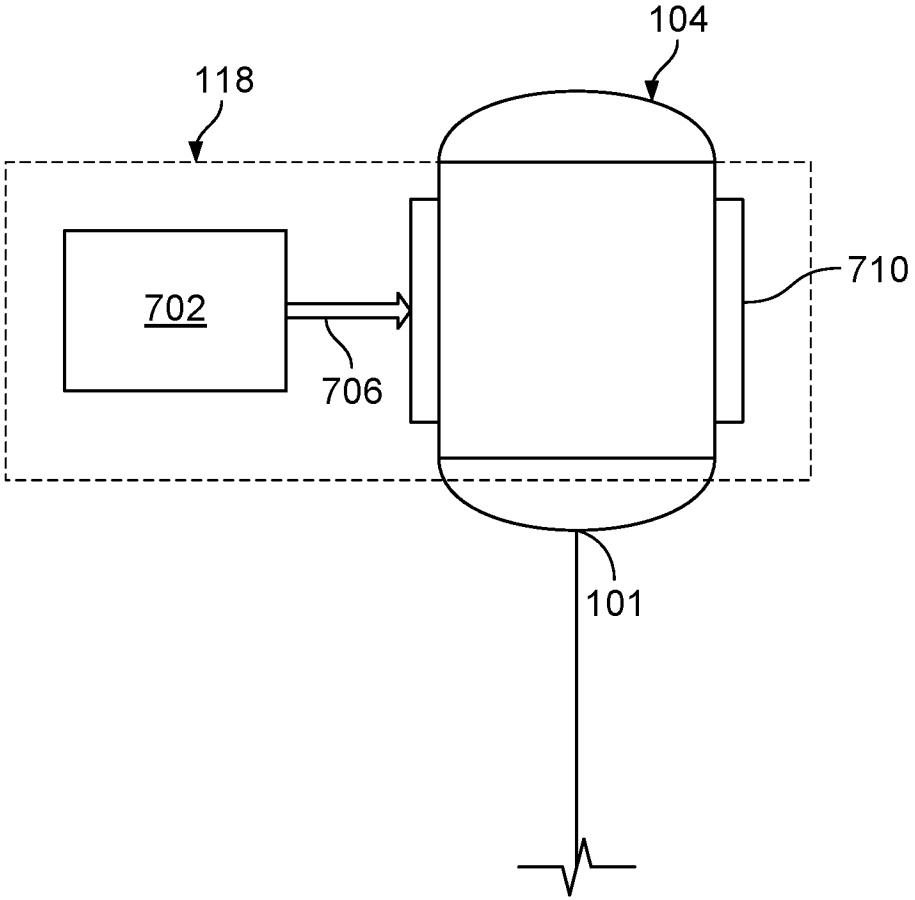
FIGS. 7A-7B are schematic diagrams of example implementations of a receiver for refrigerant fluid in a thermal management system.
Figure 7A:
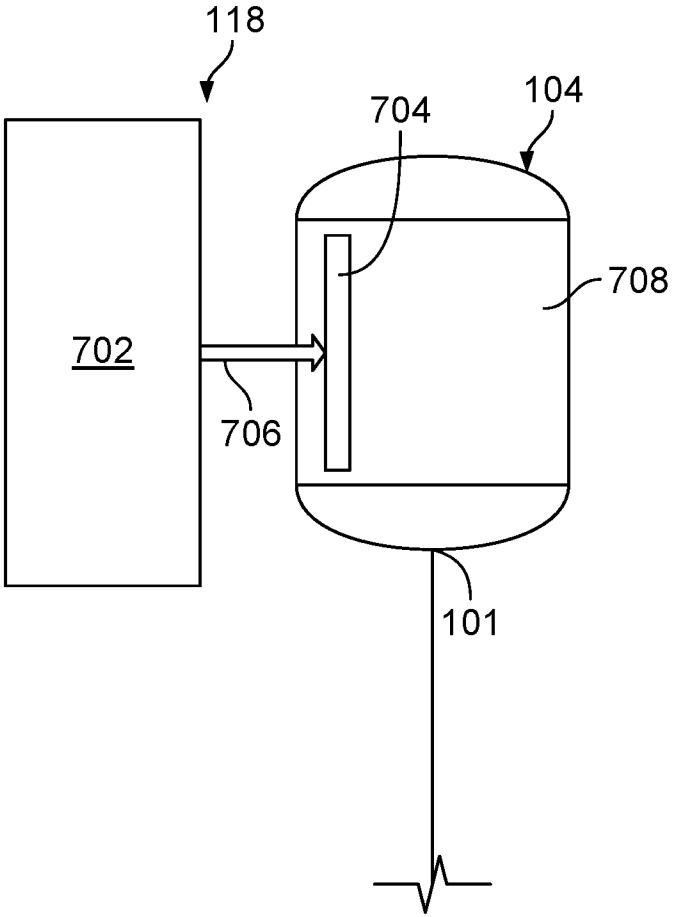

As shown in FIG. 1, an optional cooling system 118 can be thermally coupled (e.g., in conductive and/or convective thermal contact with the receiver 104 and/or the refrigerant fluid 1) to the receiver 104. In some aspects, the cooling system 118 is operated to deliver a coolant in thermal proximity with refrigerant fluid 1 in the receiver 104. For example, turning to FIGS. 7A-7B, these figures illustrate example implementations of the receiver 104 for refrigerant fluid 1 with the cooling system 118. The cooling system 118 provides a temperature-controlled environment within the receiver 104.

Cooling of the refrigerant fluid 1 (e.g., $CO_2$) is provided by a cooling fluid 706 that is flowed, from a cooling fluid source 702 (e.g., chiller, condensing unit, evaporative cooling device, thermoelectric cooling device) through a cooling heat exchanger 704 within an inner volume 708 of the receiver 104. The refrigerant fluid 1 can thermally contact the cooling heat exchanger 704, giving heat from the refrigerant fluid 1 in the receiver 104 to the cooling fluid 706 (which can circulate back to the cooling fluid source 702).

As shown in FIG. 4B, an alternative implementation of cooling system 118 is used. Cooling system 118 includes a cooling heat exchanger or evaporator 710 that is embedded within or about a shell portion (e.g., housing) of the receiver 104. The cooling system 118 provides a temperature-controlled environment within the receiver 104. Cooling of the refrigerant fluid 1 is provided by cooling fluid 706 from cooling fluid source 702 that is flowed within or about the shell of the refrigerant receiver 104, and which draws heat from the refrigerant fluid 1 in the receiver 104 (where it is exhausted in cooling fluid source 702).

Referring now to FIG. 2, another example of a thermal management system (TMS) 200 includes a $CO_2$ open-circuit refrigeration system (OCRS) 202 is shown. The $CO_2$ OCRS 202 includes certain components and optional components (including optional solenoid control valve 106, not shown) previously shown and described with reference to FIG. 1. The $CO_2$ OCRS 202 also includes a recuperative heat exchanger 204. The recuperative heat exchanger 204 has two fluid paths 209 and 211. Fluid path 209 is between the outlet 101 of the receiver 104 and the inlet 107 of expansion valve 108. Fluid path 209 includes inlet 201 and outlet 205. Fluid path 211 is between the outlet 113 of the evaporator 110 and the exhaust conduit 116 (through optional pressure control device 114). Fluid path 211 includes inlet 203 and outlet 207.

As refrigerant fluid streams flow in, e.g., counterflow, within recuperative heat exchanger 204, heat is transferred from the refrigerant fluid vapor emerging from the evaporator 110 to the refrigerant fluid 1 entering the expansion valve 108. This example that includes the recuperative heat exchanger 204 allows the $CO_2$ OCRS 250 to operate the evaporator 110 in a two-phase solid-vapor region or with a relatively small superheat, while the recuperative heat exchanger 204 handles the superheating portion of heat exchange.

As shown in FIGS. 1-2, the TMS 100 and TMS 200 (as all disclosed embodiments) also include the control system (or controller) 999 (see FIG. 10 for an exemplary embodiment) that produces control signals (based on sensed thermodynamic properties) to control operation of one or more of the various devices, e.g., optional solenoid control valve 106, expansion valve 108, etc., as needed, as well as to control operation of other components in other example implementations of a TMS. Control system 999 may receive signals, process received signals and send signals (as appropriate) from/to the sensors and control devices to operate the TMS 100 or TMS 200.

The term "control system," as used herein, can refer to an overall system that provides control signals and receives feedback data from unit controllers, such as unit controllers (e.g., programmable logic controllers, motor controllers, variable frequency drives, actuators). In some aspects, the control system includes the overall system and the unit controllers. In some aspects, a control system simply refers to as a single unit controller or a network of two or more individual unit controllers that communicate directly with each other (rather than with an overall system.

The process streams (e.g., refrigerant flows, ambient airflows, other heat exchange fluid flows) in a TMS according to the present disclosure, as well as process streams within any downstream processes with which the TMS is fluidly coupled, can be flowed using one or more flow control systems (e.g., that include the control system 999) implemented throughout the system. A flow control system can include one or more flow pumps, fans, blowers, or solids conveyors to move the process streams, one or more flow pipes through which the process streams are flowed and one or more valves to regulate the flow of streams through the pipes, whether shown in the exemplary figures or not. Each of the configurations described herein can include at least one variable frequency drive (VFD) coupled to a respective pump or fan that is capable of controlling at least one fluid flow rate. In some implementations, liquid flow rates are controlled by at least one flow control valve.

In some embodiments, a flow control system can be operated manually. For example, an operator can set a flow rate for each pump or transfer device and set valve open or close positions to regulate the flow of the process streams through the pipes in the flow control system. Once the operator has set the flow rates and the valve open or close positions for all flow control systems distributed across the system, the flow control system can flow the streams under constant flow conditions, for example, constant volumetric rate or other flow conditions. To change the flow conditions, the operator can manually operate the flow control system, for example, by changing the pump flow rate or the valve open or close position.

In some embodiments, a flow control system can be operated automatically. For example, the flow control system can be connected to a computer or control system (e.g., control system 999) to operate the flow control system. The control system can include a computer-readable medium storing instructions (such as flow control instructions and other instructions) executable by one or more processors to perform operations (such as flow control operations). An operator can set the flow rates and the valve open or close positions for all flow control systems distributed across the facility using the control system and/or a liquid level sensor for the evaporator 110. In such embodiments, the operator can manually change the flow conditions by providing inputs through the control system.

Also, in such embodiments, the control system can automatically (that is, without manual intervention) control one or more of the flow control systems, for example, using feedback systems connected to the control system. For example, a sensor (such as a pressure sensor, temperature sensor or other sensor) can be connected to a pipe through which a fluid flows. The sensor can monitor and provide a flow condition (such as a pressure, temperature, or other flow condition) of the process stream to the control system. In response to the flow condition exceeding a threshold (such as a threshold pressure value, a threshold temperature value, or other threshold value), the control system can automatically perform operations. For example, if the pressure or temperature in the pipe exceeds the threshold pressure value or the threshold temperature value, respectively, the control system can provide a signal to the pump to decrease a flow rate, a signal to open a valve to relieve the pressure, a signal to shut down process stream flow, or other signals.

In example operations of the TMS 100 and 200, the control system 999 can provide all, part, or some of the control of the $CO_2$ OCRS 102 and 202. For example, in some aspects, an operating consideration for $CO_2$ OCRS 102 and 202 is the mass flow rate of refrigerant fluid within the system. With respect to $CO_2$ OCRS 102, evaporator 110 can be configured to provide minimal mass flow rate and as a result to minimize the initial amount of refrigerant fluid 1 stored in the receiver 104. By minimizing the mass flow rate of the refrigerant fluid 1 according to the cooling requirements for heat load 112, $CO_2$ OCRS 102 operates efficiently. Each reduction in the mass flow rate of the refrigerant fluid 1 (while maintaining the same temperature set point value for heat load 112) means that the charge of refrigerant fluid 1 added to receiver 104 initially lasts longer, providing further operating time for $CO_2$ OCRS 102.

In $CO_2$ OCRS 102 and 202, expansion valve 108 is configured to control expansion of the refrigerant fluid 1 from the receiver 104. As an example, expansion valve 108 is controllable to regulate the mass flow rate of the refrigerant fluid 1 through the valve 108. In turn, for a given set of operating conditions (e.g., ambient temperature, initial pressure in the receiver 104, temperature set point value for heat load 112), the mass flow rate demand of the refrigerant fluid vapor emerging from evaporator 110 can be different. Expansion valve 108 can be controlled (e.g., by control system 999) to control expansion of refrigerant fluid 1 into the evaporator 110 in response to a temperature (or superheat) of refrigerant vapor leaving the evaporator 110.

Pressure control device 114, if used, can be controlled (e.g., by control system 999) to control the pressure of the refrigerant fluid 1 passing through the evaporator 110 and thermally contacting heat load 112 (via upstream refrigerant fluid pressure adjustments) in response to information about at least one thermodynamic quantity that is directly or indirectly related to the temperature of heat load 112. The one or more thermodynamic quantities upon which adjustment of expansion valve 108 is based are different from the one or more thermodynamic quantities upon which adjustment of pressure control device 114 is based.

A wide variety of different measurement and control strategies can be implemented in $CO_2$ OCRS 102 and 202 to achieve the control objectives discussed above. Expansion valve 108 can be communicably coupled (e.g., through control system 999) to a first measurement device and pressure control device 114 can be communicably coupled (e.g., through control system 999) to a second measurement device. The first and second measurement devices (e.g., sensors) provide information about the thermodynamic quantities upon which adjustments of the expansion valve 108 and pressure control device 114 are based. The first and second measurement devices can be implemented in many different ways, depending upon the nature of the expansion valve 108 and pressure control device 114.

In example implementations, the TMS 100 and 200 can operate differently at, and immediately following, system start-up, compared to the manner in which the systems operate after an extended running period. Upon start-up, refrigerant fluid 1 in receiver 104 may be relatively cold, and therefore the receiver pressure ($p_r$) may be lower than a typical receiver pressure during extended operation of the system 100. However, if receiver pressure $p_r$ is too low, the system 100 may be unable to maintain a sufficient mass flow rate of refrigerant fluid 1 through evaporator 110 to adequately cool heat load 112.

Figure 3:
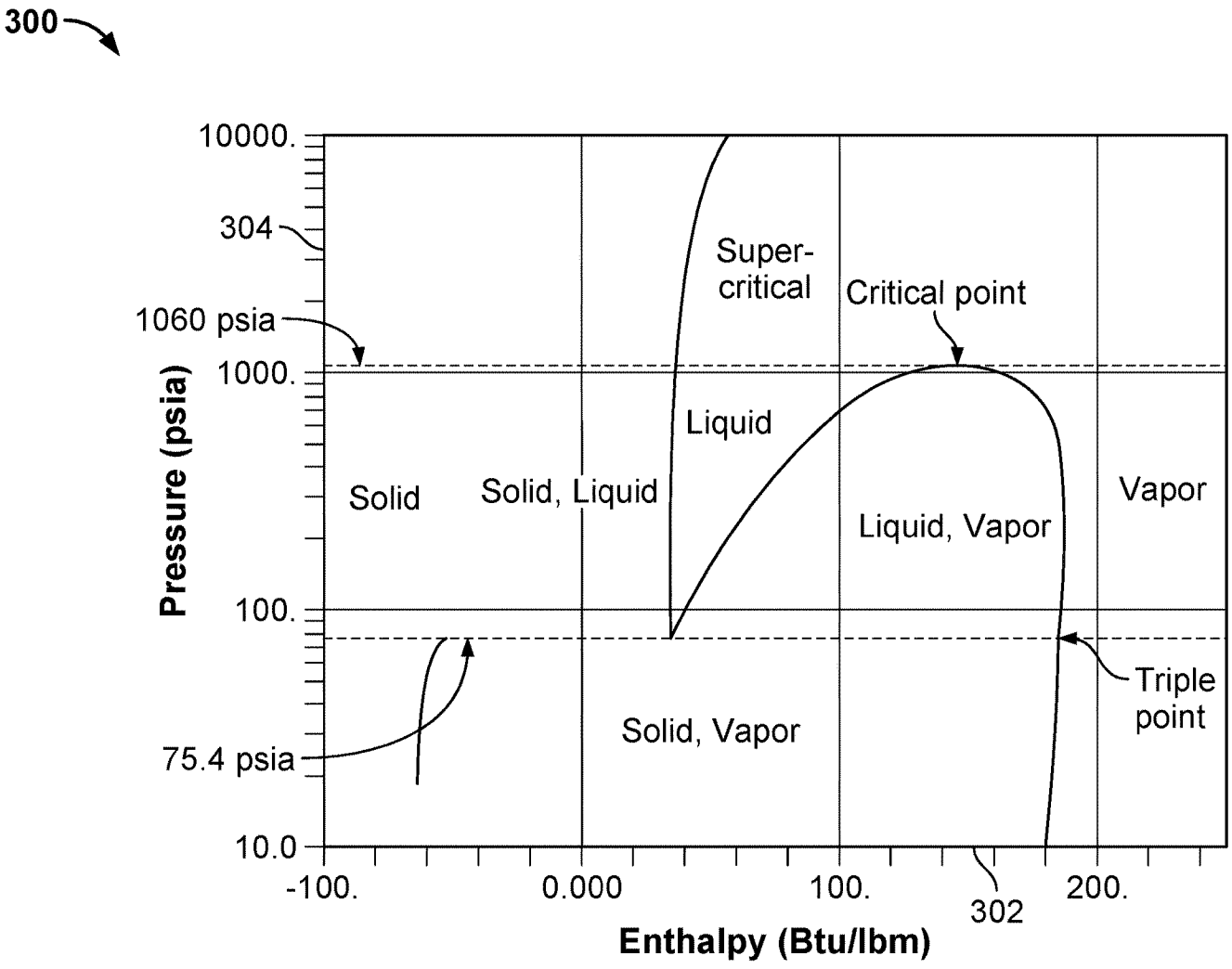
FIG. 3 is a phase diagram plot of pressure v. enthalpy for the thermal management systems of FIGS. 1 and 2 according to the present disclosure.

Referring now also to FIG. 3, the figure shows a graph 300 that shows three thermodynamics phases of $CO_2$ existing as a solid, a liquid, and a gas (vapor). Graph 300 includes x-axis 302 that is a measurement of refrigerant enthalpy (in BTU/lbm) and a y-axis 304 that is a measurement of pressure (in psia). FIG. 3 appears in "$CO_2$ Transcritical Systems Training Manual," Revision 1, April 2018 by Hussmann. The critical point of carbon dioxide is at 7,377 kPa (1060 psia) and 31° C.

Carbon dioxide states above the critical pressure and critical temperature are referred as to supercritical gas fluids and the gaseous states below the critical pressure on the left of the liquid phase are referred as to vapor states. The phases are separated by saturated curves, namely a solid+liquid curve, a solid+vapor curve, a liquid+vapor curve, and a liquid+gas curve. However, the dry ice triple point is 519.8 kPa (75.4 psia) and −56.4° C. Heating dry ice at the states below the triple point turns the dry ice directly into vapor without first going into a liquid phase. This process of transitioning from a solid phase directly to a vapor phase is sublimation. Dry ice sublimates at −78.5° C. at atmospheric pressure and this is the sublimation point. The enthalpy of sublimation is 571 kJ/kg.

Heat transfer Qo is given by:

$$Qo=m*[(1-x)*r+Cp*\Delta T],$$

where m—is the mass flow rate, x is the vapor quality of the solid-vapor mixture, r=571 kJ/kg—is the heat of sublimation, Cp=0.849 kJ/kg—is the specific heat capacity of dry ice, ΔT—is the difference between the exhaust vapor temperature and the sublimation temperature. The value of ΔT can be large—up 100° K and indicating that the sensible cooling capacity portion is substantial. The vapor quality is defined by the pressure and temperature in the $CO_2$ receiver. The higher the pressure and the lower the temperature the lower is the vapor quality. If the temperature of $CO_2$ in the receiver 104 is low, the $CO_2$ OCRS 102 or 202 may be efficient at sub-critical pressures.

Figure 4:
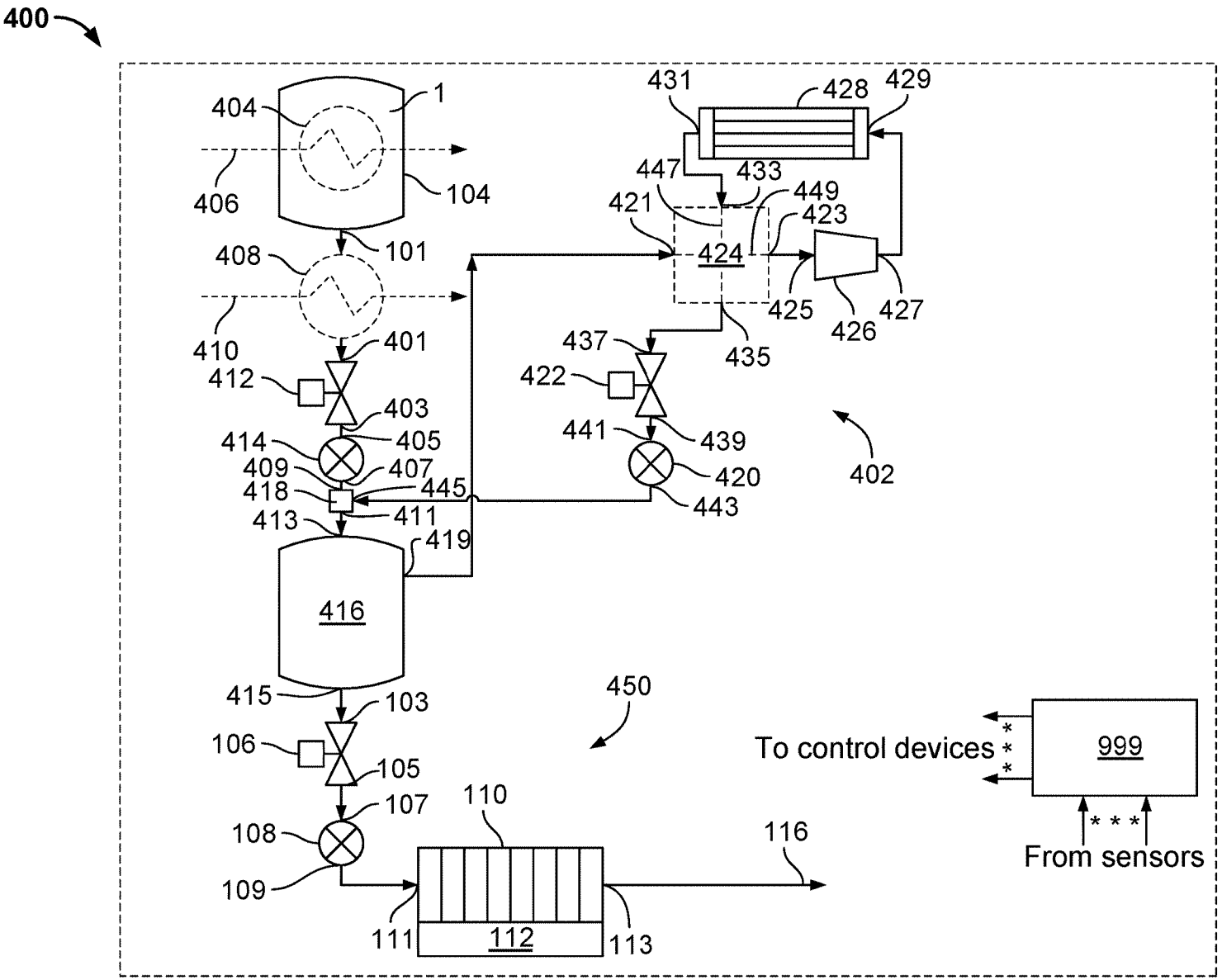
FIG. 4 is a schematic diagram of an example implementation of a thermal management system that includes a closed-circuit refrigeration system (CCRS) integrated with an OCRS that operates with one or more evaporators that provides sublimation of $CO_2$ refrigerant according to the present disclosure.

FIG. 4 is a schematic diagram of an example implementation of a thermal management system (TMS) 400 that includes a closed-circuit refrigeration system (CCRS) 402 integrated with an OCRS 450 that operates with one or more evaporators that provide sublimation of $CO_2$ refrigerant. Referring to FIG. 4, example implementations of the TMS 400 use $CO_2$ as a refrigerant fluid 1 that transfers heat to a solid-vapor refrigerant phase that sublimates to a vapor in the OCRS 450 (as a $CO_2$ OCRS 450). In this example, certain components of the TMS 400 are similar to or the same as components described with reference to FIGS. 1 and 2, such as receiver 104 (with outlet 101), optional solenoid valve 106 (with inlet 103 and outlet 105), expansion valve 108 (with inlet 107 and outlet 109), evaporator (or cold plate) 110 (with inlet 111 and outlet 113), one or more heat loads 112, and exhaust conduit 116 (which can include an optional pressure control device 114 as previously described).

The example implementation of TMS 400 also includes an optional solenoid valve 412 having an inlet 401 and an outlet 403, an expansion valve 414 having an inlet 405 and an outlet 407, a junction 418 having inlet 409, inlet 445, and outlet 411. TMS 400 also includes flash tank 416 (one or more flash tanks 416) having inlet 413, liquid outlet 415, and vapor outlet 419.

In this example, the optional solenoid control valve 412 may be employed when the expansion valve 412 cannot fully close the refrigerant fluid 1 from the receiver 104 when the TMS 400 is in an off state. Optional solenoid control valves can be used when an associated expansion valve cannot fully close the refrigerant fluid flow out of the associated expansion valve.

The CCRS 402, in this example, includes a compressor 426 having an inlet 425 and an outlet 427, a heat rejection exchanger 428 having an inlet 429 and an outlet 431, an optional solenoid valve 422 having an inlet 437 and outlet 439, and an expansion valve 420 having an inlet 441 and outlet 443. The heat rejection exchanger 428 can be either a gas cooler or a condenser (e.g., depending on the state of the refrigerant fluid in compressed vapor state and ambient temperature).

The CCRS 402 is configured to recirculate vapor refrigerant formed in the flash tank 416 and turn the refrigerant liquid from the liquid outlet 415 into a low vapor quality two-phase liquid-vapor mixture. The refrigerant fluid 1, as $CO_2$, in the receiver 104 initially may be in a state above the critical point or a state below the critical point of the $CO_2$. In the first case, the TMS 400 can be in a trans-critical cycle since the receiver 104 operates as a pressure above the critical point and the evaporation/sublimation is processed at a pressure below the critical point. In the second case, the TMS 400 can be in a sub-critical cycle since all operating pressures within the CCRS 402 are below the critical point. The CCRS 402 can also operate in either a trans-critical or a sub-critical state depending on a discharge pressure of compressor 426. In the first case the heat rejection exchanger 428 is implemented as a gas cooler, and in the second case the heat rejection exchanger 428 is implemented as a condenser.

The OCRS 450 uses a solid-vapor mixture of refrigerant fluid 1 (as $CO_2$) in the evaporator 110 that sublimates to a vapor without first melting into a liquid. Initially the refrigerant stored in the receiver 104 can be at a pressure above or below the critical point. In the case where the refrigerant is stored in the receiver 104 and starts at a pressure above the critical point and ends at an end pressure below the critical point, then the OCRS 450 operates in a trans-critical cycle; otherwise, if the end pressure ends still above the critical point, then the OCRS 450 operates as a super-critical cycle. If the initial pressure of refrigerant fluid 1 in the receiver 104 is below the critical point, then the OCRS 450 operates in a sub-critical cycle. In all cases, the refrigerant fluid 1 needs to expand in volume below a corresponding triple point and sublimate at an exhaust pressure (pressure in the exhaust conduit 116).

The TMS 400, in some aspects, can operate at three pressure levels: a high pressure in the receiver 104 and at the outlet 427 of the compressor 426, an intermediate pressure in the flash tank 416, and a low pressure in the evaporator 110, which is a pressure below the triple point pressure of the refrigerant fluid 1. The refrigerant fluid 1 is expanded by expansion valve 414 at a constant enthalpy from the high pressure in the receiver 104 to the intermediate pressure in the flash tank 416. Two phases are formed after expansion—a liquid phase that settles to the bottom of the flash tank 416 and which exits the flash tank via liquid outlet 415 and a vapor phase that is above the liquid phase and which exits the flash tank 416 via vapor outlet 419. The liquid portion at the bottom of the flash tank 416 is further expanded by expansion valve 108 at a constant enthalpy to a pressure below the triple point, turning the liquid phase that was at the intermediate pressure in the flash tank 416 into a two-phase mixture of solid, e.g., for $CO_2$, dry-ice, and vapor at the sublimation pressure.

The two-phase mixture of solid and vapor is transported to the evaporator 110, where the solid portion, e.g., dry-ice, sublimates absorbing heat from the heat load(s) 112 in at least one of thermal conductive or convective contact with the evaporator 110, thus turning the two-phase mixture to a saturated state vapor, is super-heated up towards a temperature approaching the heat load temperature, and the vapor is discharged from the evaporator 110 through the exhaust conduit 116.

The CCRS 402 operates either as a trans-critical or a subcritical refrigeration system, as mentioned above. Refrigerant vapor phase of outlet 419 from the flash tank 416 is compressed in the compressor 426 that provides refrigerant vapor that is at a high temperature and a high pressure to be fed to the heat rejection exchanger 428, e.g., gas cooler or condenser, where the refrigerant vapor is cooled in the gas cooler (with no phase change) or is condensed in the condenser (with a phase change from vapor to liquid). The cooled or condensed refrigerant is expanded at a constant enthalpy in the expansion valve 420 and mixed in junction 418 with a liquid phase from expansion device 414 to settle at the bottom of the flash tank 416, with the vapor phase formed after expansion by expansion devices 414 and 420 being induced into the compressor 426.

The TMS 400 can operate with two high pressures. A first pressure is in the receiver 104 and a second pressure is at the outlet 427 of the compressor 426. Normally those pressures are not equal. The initial pressure in the receiver 104 may or may not be higher than the compressor discharge pressure (at outlet 427). The final pressure in the receiver 104 can be lower than the compressor discharge pressure.

In some aspects, the flash tank 416 can reduce refrigerant enthalpy at the inlet 111 to the evaporator 110 and thus increase the so called "refrigeration effect" or more specifically the "net refrigeration effect" in the evaporator 110. An increase in net refrigeration effect reduces cooling mass flow rate demand and reduces an amount of required refrigeration charge/recharge. Net refrigeration effect can be expressed as:

$$NRE=h_l-he$$

where NRE=Net Refrigeration Effect (Btu/lb.); $h_l$=enthalpy of vapor leaving evaporator (Btu/lb.) and $h_e$=enthalpy of vapor entering evaporator (Btu/lb.). See www.engineering toolbox.com/refrigeration-formulas-d_1695.html.

In some aspects, the CCRS 402 recycles and reuses the formed refrigerant vapor in the flash tank 416. The CCRS 402 can maintain a low pressure and temperature in the flash tank 416 in standby mode provided that the flash tank 416 is sufficiently insulated. That is, the low pressure and temperature in the flash tank 416 is maintained according to the amount of insulation provided in the flash tank 416.

Figure 6:
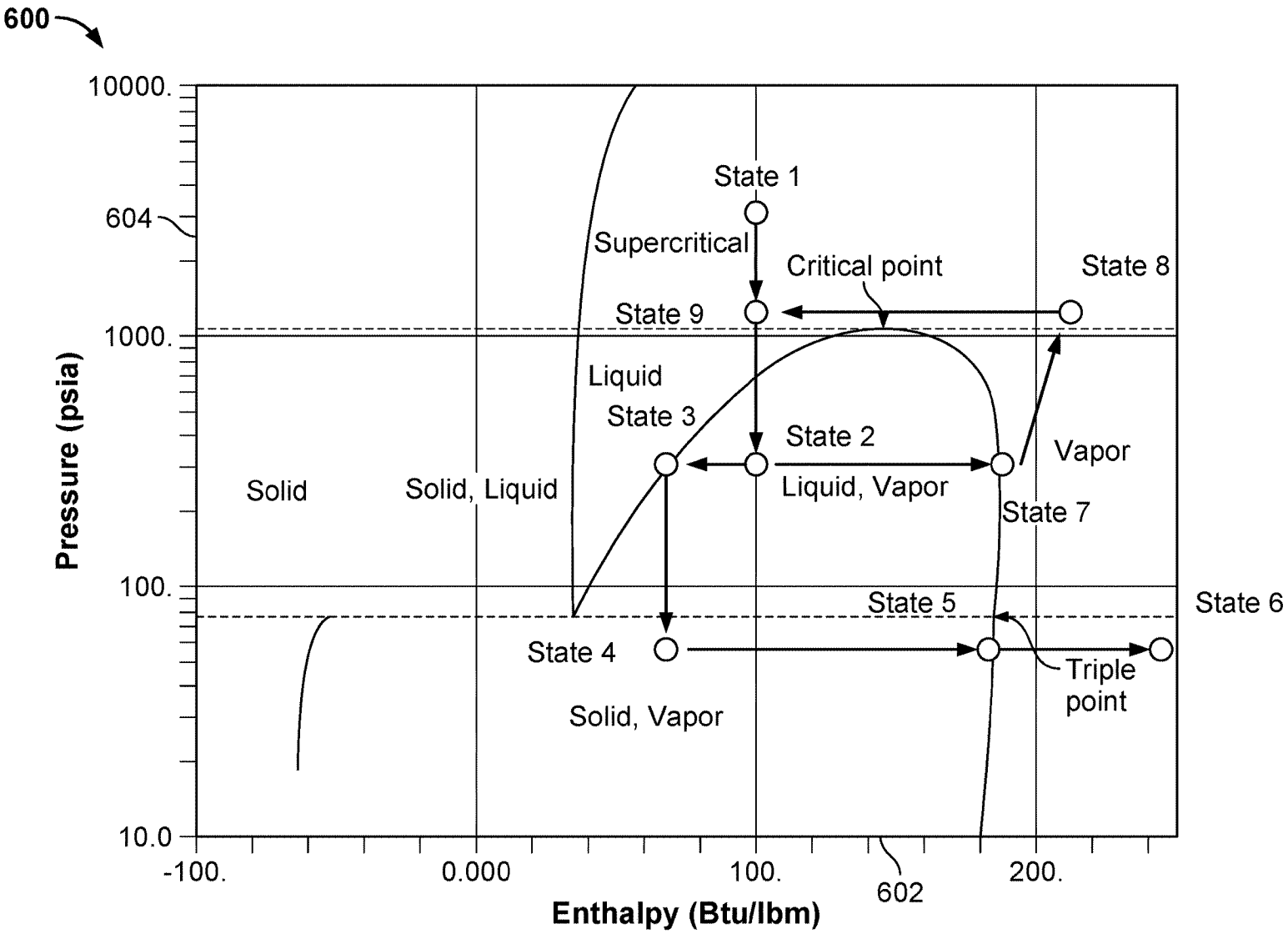
FIG. 6 is a phase diagram plot of pressure v. enthalpy for the thermal management systems of FIGS. 4 and 5 according to the present disclosure.

Referring to FIG. 4, $CO_2$ (as refrigerant fluid 1) in the receiver 104 is initially in a supercritical state, preferably, above the liquid zone (as described more fully with reference to FIG. 6 as State 1). The supercritical $CO_2$ refrigerant is thus at a pressure above the critical pressure of 1060 psia at ambient temperature above 31° C. The supercritical $CO_2$ is enthalpically expanded (i.e., State 2 in FIG. 6) in the expansion valve 414 to an ambient pressure at or below an intermediate pressure of about 300 psia, which is above the triple point pressure (75.4 psia). At this condition, the high-pressure $CO_2$ turns into a liquid-vapor mixture in the flash tank 416 (i.e., State 3 of FIG. 6). The liquid in the flash tank 416 drops to the bottom of the flash tank 416, whereas the vapor in the flash tank 416 exits the flash tank 416 through the vapor outlet 419.

The refrigerant liquid exits the flash tank 416 and is expanded in expansion valve 108 (i.e., State 4 in FIG. 6) into a solid-vapor mixture at a pressure below the triple point pressure. The solid-vapor mixture is transported to the inlet 111. The solid-vapor mixture in the evaporator 110 is used to cool heat load(s) 112 attached to the evaporator 110. As heat is drawn away from the heat loads 112 attached to the evaporator 110, the dry-ice sublimates (transitions from solid or solid-vapor mixture directly to vapor, without going through a liquid state at a constant sublimation temperature until it reaches the saturation state) (i.e., State 5 of FIG. 6). Then the $CO_2$ vapor heats up to a temperature that approaches the heat load temperature. The resulting $CO_2$ vapor is exhausted to the ambient environment through the exhaust conduit 116 (i.e., State 6 of FIG. 6).

The vapor that exits the flash tank 416 exits at an intermediate pressure of about 300 psia (i.e., State 7 of FIG. 6). The vapor at the intermediate pressure enters the compressor 426 and is discharged from the outlet 427 of the compressor 426 at the second high pressure (i.e., State 8 of FIG. 6) as the compressor discharge pressure. The compressor discharge pressure can be the second high pressure (e.g., about 1100 psia., i.e., above the critical pressure of 1060 psia). At the outlet 431 of the heat rejection exchanger 428, the refrigerant is at the compressor discharge pressure (e.g., about 1100 psia., i.e., above the critical pressure of 1060 psia, State 9 of FIG. 6).

As shown in FIG. 4, the TMS 400 can include an optional recuperative heat exchanger 424 as part of the CCRS 402. The heat recuperation exchanger 424 includes a first fluid path 447 between inlet 421 and outlet 423, and a second fluid path 449 between inlet 433 and outlet 435. In some aspects, the heat recuperation exchanger 424 allows operation of the evaporator 110 in a two-phase region, and at the same time recuperates the unused enthalpy with no losses. Further, first fluid path 447 fluidly connects the vapor outlet 419 of the flash tank 416 and the inlet 425 of the compressor 426. The second fluid path 449 fluidly connects the outlet 431 of the heat rejection exchanger 428 and the inlet 441 to the expansion valve 420 (or the inlet 437 to the optional solenoid valve 422, if used). As the two refrigerant fluid streams flow in opposite directions within recuperative heat exchanger 424, heat is transferred from the refrigerant fluid emerging from the vapor outlet 419 of the flash tank 416 to the refrigerant fluid entering the expansion valve 420. The recuperative heat exchanger 424 allows the TMS 400 to operate the evaporator 110 in a two-phase solid-vapor region or with a relatively small superheat.

In some aspects, the recuperative heat exchanger 424 reduces refrigerant enthalpy at the inlet 111 to the evaporator 110 and thus increases the so called "refrigeration effect" or more specifically the "net refrigeration effect" in the evaporator 110, as stated above. Since the refrigerant fluid (e.g., $CO_2$) temperature in the receiver 104 can be important, it makes sense to keep the receiver 104 insulated or keep the receiver 104 in a temperature-controlled environment.

The lower the temperature in the receiver 104 is, the lower the cooling mass flow rate demand and refrigerant charge demand. Heat transfer Qo is given by:

$$Qo=m*[(1-x)*r+Cp*\Delta T],$$

where m—is the mass flow rate, x is the vapor quality of the solid-vapor mixture, r=571 kJ/kg—is the heat of sublimation, Cp=0.849 kJ/kg—is the specific heat capacity of dry-ice, and ΔT—is the difference between the exhaust vapor temperature and the sublimation temperature. The value of ΔT can be large—up 100° K and indicating that the sensible cooling capacity portion is substantial. The vapor quality is defined by the pressure and temperature in the receiver 104. The higher the pressure and the lower the temperature, the lower is the vapor quality. If the temperature of refrigerant fluid 1 ($CO_2$) in the receiver 104 is low, the TMS 400 may be efficient at sub-critical pressures.

In the example of CCRS 402, the flow circuit with compressor 426, the heat rejection exchanger 428, and the expansion valve 420 is configured to recirculate vapor refrigerant formed in the flash tank 416 and turn the vapor to a low vapor quality two-phase mixture, where low vapor quality is less than 0.5, in a range of 0.1 to 0.5 and, where "Vapor quality" is thus defined as mass of vapor/total mass (vapor+liquid). In this sense, vapor quality cannot exceed "1" or be equal to a value less than "0." In some implementations the vapor quality can be higher than 0.5, but would not exceed 1.

In practice, vapor quality may be expressed as "equilibrium thermodynamic quality" that is calculated as follows:

$$X=(h-h')/(h''-h'),$$

where h—is specific enthalpy, specific entropy or specific volume, '—means saturated liquid and "—means saturated vapor. In this case X can be mathematically below 0 or above 1, unless the calculation process is forced to operate differently. Either approach for calculating vapor quality is acceptable.

As further shown in FIG. 4, TMS 400 can include an optional internal cooler 404, e.g., a micro-refrigeration system, which can cool refrigerant fluid 1 in the receiver 104 with a cooling source 406. The cooling of the high-pressure refrigerant fluid 1 in the receiver 104 can reduce enthalpy at the inlet 111 to the evaporator 110 and thus increase the net refrigeration effect in the evaporator 110. The larger the refrigeration effect, the lower the cooling mass flow rate demand and the required refrigeration charge in the receiver 104. In some aspects where the cooler 404 is used, the receiver 104 can be insulated or kept in a temperature controlled environment. As further shown in FIG. 4, TMS 400 can include an optional external cooler 408 that is in proximity to the outlet 101 of the receiver 104 and which cools refrigerant fluid 1 exiting the receiver 104 with a cooling source 410.

Figure 5:
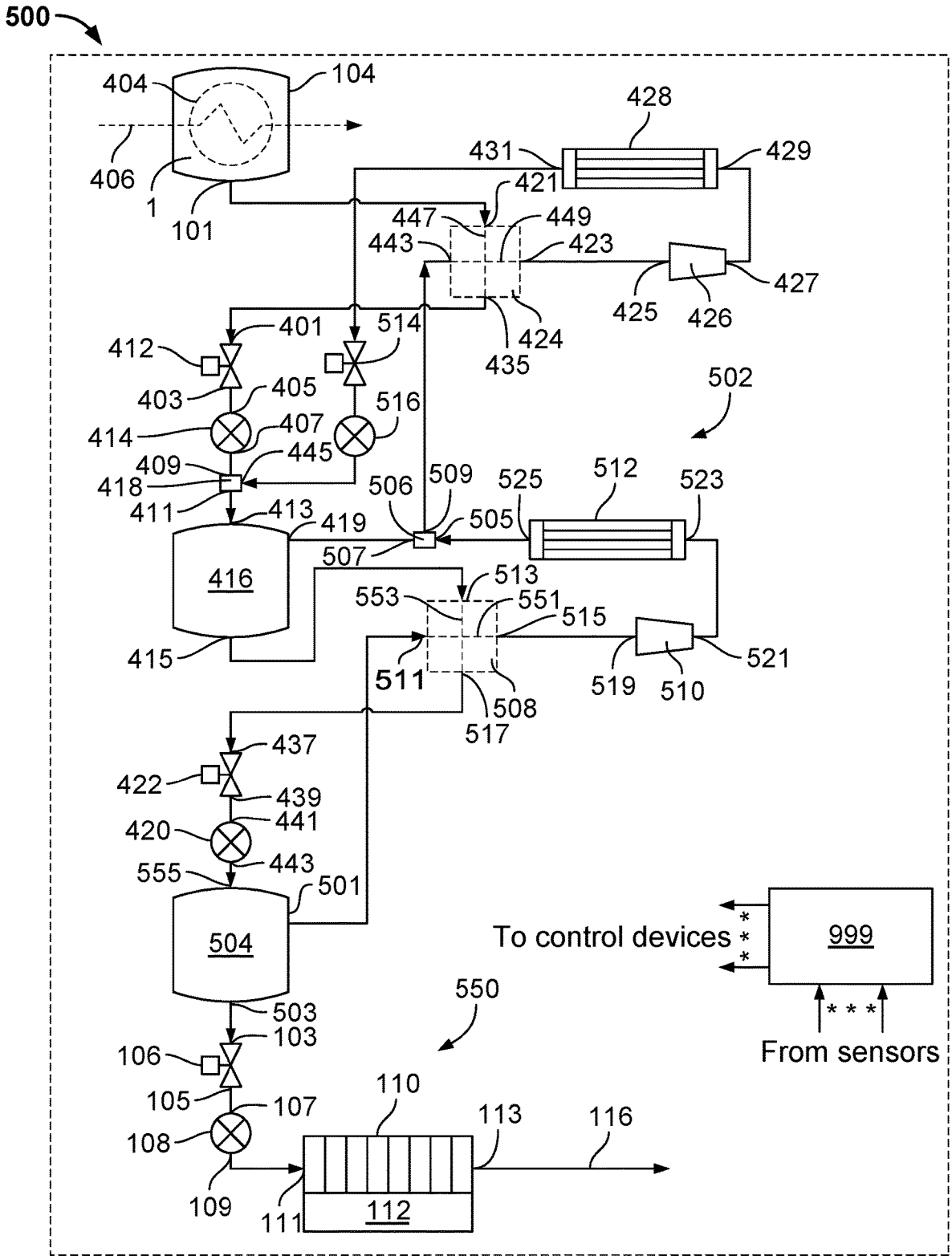
FIG. 5 is a schematic diagram of another example implementation of a thermal management system that includes a CCRS integrated with an OCRS that operates with one or more evaporators that provides sublimation of $CO_2$ refrigerant according to the present disclosure.

Referring now to FIG. 5, another example of a thermal management system (TMS) 500 that includes a closed-circuit refrigeration system (CCRS) 502 integrated with an OCRS 550 that operates with one or more evaporators that provide sublimation of $CO_2$ refrigerant. The TMS 500 includes certain components and optional components (including optional solenoid control valve 106, not shown) previously shown and described with reference to FIG. 5.

As compared to TMS 400, the TMS 500 further includes a second flash tank 504 having an inlet 555, a vapor outlet 501, and a liquid outlet 503. The inlet 555 is fluidly coupled to the liquid outlet 415 of the flash tank 416, while liquid outlet 503 is fluidly coupled to inlet 103 of solenoid valve 106, if used, or the inlet 107 of an expansion valve 108. The vapor outlet 501 is fluidly coupled to the inlet 425 of the compressor 426. Further, TMS 500 includes a second compressor 510 having an inlet 519 and an outlet 524, as well as a second heat rejection exchanger 512 having an inlet 523 and an outlet 525.

Further, TMS 500 includes an optional solenoid valve 514 and an expansion valve 516 fluidly coupled between the outlet 525 and junction 418. Another junction 506 having inlets 505 and 507 and outlet 509 fluidly couples the outlet 431 of heat rejection exchanger 428 and the vapor outlet 419 to the inlet 519 of the compressor 510.

In this example, the TMS 500 employs two-stage compression and two flash tanks 416, 504, to allow for further reduction in enthalpy at the inlet 111 to the evaporator 110, and thus provides an additional increase in the net refrigeration effect in the evaporator 110. The larger the net refrigeration effect, the lower the cooling mass flow rate demand and required refrigeration charge. The CCRS 502 recycles and reuses the formed refrigerant vapor in the flash tank 504 similar to how it recycles and reuses the formed refrigerant vapor in the flash tank 416, as in FIG. 4.

The TMS 500 can operate at three pressure levels: a high pressure (e.g., above 1000 psia such as 2000 psia up to e.g., 10,000 psia) in the receiver 104 and at the outlet, an intermediate pressure (e.g., about 300 psia such as 200 psia up to e.g., 800 psia) in the flash tank 416 and the flash tank 504 and a low pressure (i.e., below 75.4 psia) in the evaporator 110 which is at a pressure below the triple point pressure. The refrigerant fluid 1 is expanded by expansion valve 414 at a constant enthalpy from the high pressure in the receiver 104 to the intermediate pressure in the flash tank 416. The refrigerant from the liquid outlet 415 is further expanded by expansion valve 420 at a constant enthalpy from the high intermediate pressure in the flash tank 416 to the low intermediate pressure in the flash tank 504.

Two refrigerant phases are formed after expansion by expansion devices 414 and 420—a liquid phase that settles to the bottom of the flash tank 416 and flash tank 504 and a vapor phase that is above the liquid phase in each flash tank 416, 504. The liquid portion at the bottom of the flash tank 416 is further expanded by expansion valve 420 at a constant enthalpy to a pressure below the triple point to turn the liquid that was at the intermediate pressure in the flash tank 504 into a two-phase mixture of solid, e.g., for $CO_2$, dry-ice, and vapor at the sublimation pressure. The two-phase mixture of solid and vapor is fed to the evaporator 110, where the solid portion, e.g., dry-ice, sublimates absorbing heat from the heat loads 112 attached to the evaporator 110 turning the two-phase mixture to a saturated state. The vapor is superheated up to a temperature approaching the heat load temperature, and discharged from the evaporator 110 through the exhaust conduit 116.

The CCRS 502 operates either as a trans-critical or a subcritical refrigeration system. Vapor from the flash tank 504 is compressed in the compressor 510 providing vapor that is at a high temperature and the high pressure that is fed to the heat rejection exchanger 512, e.g., a gas cooler or condenser, where the vapor is cooled in the gas cooler (without phase change) or is condensed in the condenser (with phase change). Any remaining vapor is fed to the inlet 505 of the junction 506 together with the vapor from flash tank 416. The vapor from the junction 506 and the vapor from the flash tank 416 are compressed in the compressor 426 providing vapor that is at a high temperature and the high pressure, and that are transported to the heat rejection exchanger 428, e.g., gas cooler or condenser, where the vapor is cooled in the gas cooler or is condensed in the condenser.

The cooled or condensed refrigerant is expanded at a constant enthalpy in the expansion device 516 with a liquid phase from expansion devices 414 and 420 settling at the bottom of the flash tank 504 and a vapor phase formed after expansion by expansion devices 414 and 420 being induced into the compressor 510. Thus, as shown in this example, the CCRS 502 operates as a $CO_2$ transcritical booster system in some aspects.

The TMS 500 operates with three high pressures (i.e., a pressure that is above the critical pressure). A first high pressure is in the receiver 104 and second and third high pressure are at the outlets 521 and 427 of the compressors 510 and 426, respectively. In some cases, those pressures are not equal. The initial pressure in the receiver 104 may or may not be higher than the compressor discharge pressures. The final pressure in the receiver 104 can be lower than the compressor discharge pressures.

The flash tanks 416 and 504 each reduce refrigerant enthalpy at the inlet 111 to the evaporator 110 and thus increases the so called "refrigeration effect" or more specifically the "net refrigeration effect" in the evaporator 110. An increase in net refrigeration effect reduces cooling mass flow rate demand and reduces an amount of required refrigeration charge/recharge.

As shown in FIG. 5, TMS 500 can include optional recuperative heat exchanger 424, which operates as described with reference to FIG. 4. TMS 500 can also include optional recuperative heat exchanger 508. Recuperative heat exchanger 508 includes a first fluid path 551 with an inlet 511 and an outlet 515. Inlet 511 is fluidly coupled to vapor outlet 501, while outlet 515 is fluidly coupled to inlet 519 of the compressor 510. Recuperative heat exchanger 508 also includes a second fluid path 553 with an inlet 513 and an outlet 517. Inlet 513 is fluidly coupled to liquid outlet 415, while outlet 517 is fluidly coupled to inlet 437 of the optional solenoid valve 422 if used, or otherwise to the inlet 441 of expansion valve 420.

The TMS 500, employing two-stage compression and two flash tanks 416, 504, allows for further reduction in enthalpy at the inlet 111 to the evaporator 110, and thus provides a further increase in the net refrigeration effect in the evaporator 110 (compared to the embodiment of FIG. 4). The CCRS 502 recycles and reuses the formed refrigerant vapor in the flash tank 504 similar to how it recycles and reuses the formed refrigerant vapor in the flash tank 416.

The optional heat recuperation exchanger 508 allows operation of the evaporator 110 in a two-phase region, and at the same time recuperates the unused enthalpy with no losses. As the two refrigerant fluid streams flow in opposite directions within recuperative heat exchanger 508, heat is transferred from the refrigerant vapor emerging from the flash tank 416 to the refrigerant fluid entering the expansion valve 108. The recuperative heat exchanger reduces refrigerant enthalpy at the inlet 111 to the evaporator 110, and thus increases the so called "refrigeration effect" or more specifically the "net refrigeration effect" in the evaporator 110, as stated above.

As shown in FIGS. 4-5, the TMS 400 and TMS 500 (as all disclosed embodiments) also include the control system (or controller) 999 (see FIG. 10 for an exemplary embodiment) that produces control signals (based on sensed thermodynamic properties) to control operation of one or more of the various devices, e.g., optional solenoid control valve 106, expansion valve 108, etc., as needed, as well as to control operation of other components in other example implementations of a TMS. Control system 999 may receive signals, process received signals and send signals (as appropriate) from/to the sensors and control devices to operate the TMS 400 or TMS 500.

The control system 999 (either alone or in combination with sensors or control devices) can operate the TMS 400 and 500 to control the mass flow rate of refrigerant fluid within the TMS 400 and 500. Evaporator 110 can be configured to provide minimal mass flow rate and as a result to minimize the initial amount of refrigerant stored in the refrigerant. By minimizing the mass flow rate of the refrigerant fluid according to the cooling requirements for heat load 112, TMS 400 and 500 operate efficiently. Each reduction in the mass flow rate of the refrigerant fluid (while maintaining the same temperature set point value for heat load 112) means that the charge of refrigerant fluid added to receiver 104 initially lasts longer, providing further operating time for TMS 400 and 500.

In TMS 400, for example, expansion valve 108 can be configured to control expansion of the refrigerant from the flash tank 416. As an example, the expansion valve 108 regulates the mass flow rate of the refrigerant fluid 1 through the valve 108. In turn, for a given set of operating conditions (e.g., ambient temperature, initial pressure in the receiver 104, amount of expansion caused by expansion device 414, temperature set point value for heat load 112, etc.), the mass flow rate demand of the refrigerant fluid emerging from evaporator 110 may be different. Expansion valve 108 typically controls expansion of refrigerant into the evaporator 110 in response to a temperature (or superheat) of refrigerant vapor leaving the evaporator 110. A wide variety of different measurement and control strategies can be implemented in TMS 400 and 500 to achieve the control objectives discussed above.

In certain embodiments, the TMS 400 and 500 disclosed herein operate differently at, and immediately following, system start-up, compared to the manner in which the systems operate after an extended running period. Upon start-up, refrigerant fluid 1 in receiver 104 may be relatively cold, and therefore the receiver pressure ($p_r$) may be lower than a typical receiver pressure during extended operation of the system. However, if receiver pressure $p_r$ is too low, the system may be unable to maintain a sufficient mass flow rate of refrigerant fluid through evaporator 110 to adequately cool heat load 112.

FIG. 6 is a phase diagram plot of pressure v. enthalpy for the thermal management systems 400 and 500 of FIGS. 4 and 5 according to the present disclosure. FIG. 6 shows graph 600 that includes a plot of pressure in psi absolute (on y-axis 604) v. enthalpy in Btu/lbm (British thermal units per pound) (on x-axis 602). On FIG. 6, a thermodynamic cycle for the $CO_2$ is shown as comprised of nine states. (FIG. 6 without state 1 to state 9 indicated thereon, appeared in "$CO_2$ Transcritical Systems Training Manual," Revision 1, April 2018 by Hussmann.) Exemplary pressures for each of the states are shown in FIG. 6.

State 1 is the initial refrigerant state in the receiver 104 that is at a high pressure in the receiver 104 (i.e., above the critical pressure of 1060 psia, e.g., about 2000 psia.). State 2 is the two-phase state refrigerant after expansion in the expansion valve 414, which is at the intermediate pressure (e.g., about 300 psia.). State 3 is the saturated liquid at the bottom of the flash tank 416, which is also at the intermediate pressure (e.g., about 300 psia.). State 4 is the solid-vapor two-phase refrigerant state after expansion in the expansion valve 108, which is at the low pressure (e.g., about 65 psia.). State 5 is the saturated vapor, which is at the low pressure (e.g., about 65 psia.). State 6 is the vapor at the exit from the evaporator 110 and the exhaust state from exhaust conduit 116, which is at the low pressure (e.g., about 65 psia.). State 7 is the saturated vapor in the flash tank 416, which is at the intermediate pressure (e.g., about 300 psia.). State 8 is the compressor discharge at the outlet 427 of the compressor 426, i.e., the compressor discharge pressure, being at a second high pressure (e.g., about 1000 psia., i.e., above the critical pressure of 1060 psia). State 9 is the refrigerant state at the outlet 431 of the heat rejection exchanger 428, which is at the compressor discharge pressure (e.g., about 1100 psia., i.e., above the critical pressure of 1060 psia).

FIG. 6 additionally shows the three thermodynamics phases of $CO_2$ existing as a solid, a liquid, and a gas (vapor). The critical point of carbon dioxide is at 7,377 kPa (1060 psia) and 31° C. Carbon dioxide states above the critical pressure and critical temperature are referred as to supercritical gas fluids and the gaseous states below the critical pressure on the left of the liquid phase are referred as to vapor states. The phases are separated by saturated curves, namely a solid+liquid curve, a solid+vapor curve, a liquid+vapor curve, and a liquid+gas curve. The dry-ice triple point is 519.8 kPa (75.4 psia) and minus −56.4° C. Heating dry-ice at the states below the triple point turns the dry-ice directly into vapor without first going into a liquid phase. This process of transitioning from a solid phase directly to a vapor phase is sublimation. Dry-ice sublimates at −78.5° C. at atmospheric pressure and this is the sublimation point. The enthalpy of sublimation is 571 kJ/kg.

The thermal management systems and methods disclosed herein can implemented as part of (or in conjunction with) directed energy systems such as high energy laser systems. Due to their nature, directed energy systems typically present several cooling challenges, including certain heat loads for which temperatures are maintained during operation within a relatively narrow range.

Figure 10:
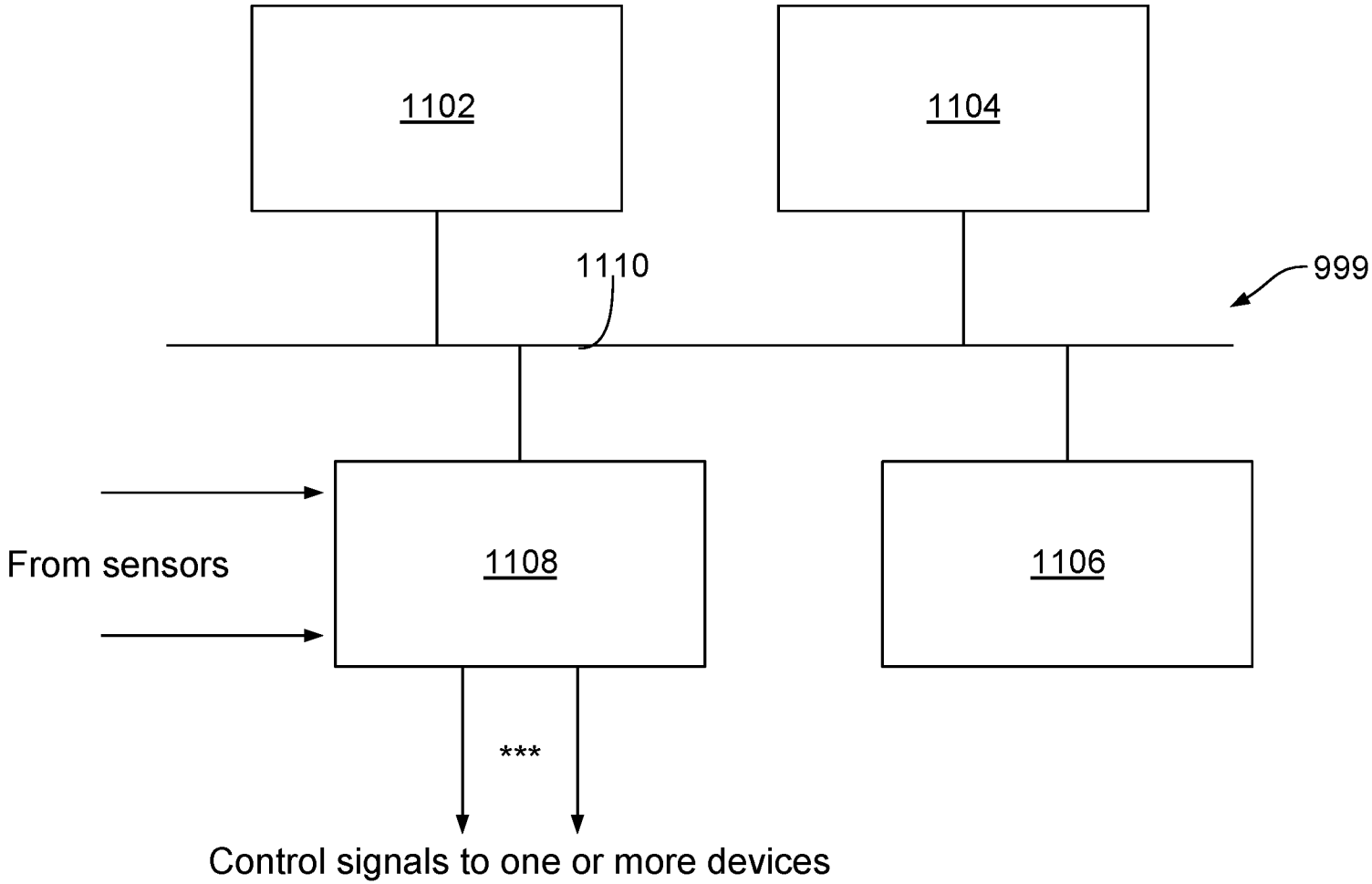
FIG. 10 is a block diagram of a control system or controller according to the present disclosure.

FIG. 10 shows one example of a directed energy system, specifically, a high energy laser system 1000. System 1000 includes a bank of one or more laser diodes 1002 and an amplifier 1004 connected to a power source 1006. During operation, laser diodes 1002 generate an output radiation beam 1008 that is amplified by amplifier 1004, and directed as output beam 1010 onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes. To regulate the temperatures of various components of directed energy systems such as diodes 1002 and amplifier 1004, such systems can include components and features of the thermal management systems disclosed herein.

In FIG. 10, evaporator 110 (e.g., cold plate 110) is thermally coupled to diodes 1002. (In some embodiments another heat exchanger 1012 is thermally coupled to amplifier 1004.) The other components of the thermal management systems 100, 200, 400, and 500 disclosed herein are not shown for clarity. However, any of the features and components discussed above can optionally be included in directed energy systems. Diodes 1002, due to their temperature-sensitive nature, effectively function as heat load 112 in system 150, while amplifier 1004 functions as another heat load.

System 1000 is one example of a directed energy system that can include various features and components of the thermal management systems and methods described herein. However, it should be appreciated that the thermal management systems and methods are general in nature, and can be applied to cool a variety of different heat loads under a wide range of operating conditions.

Figure 11:
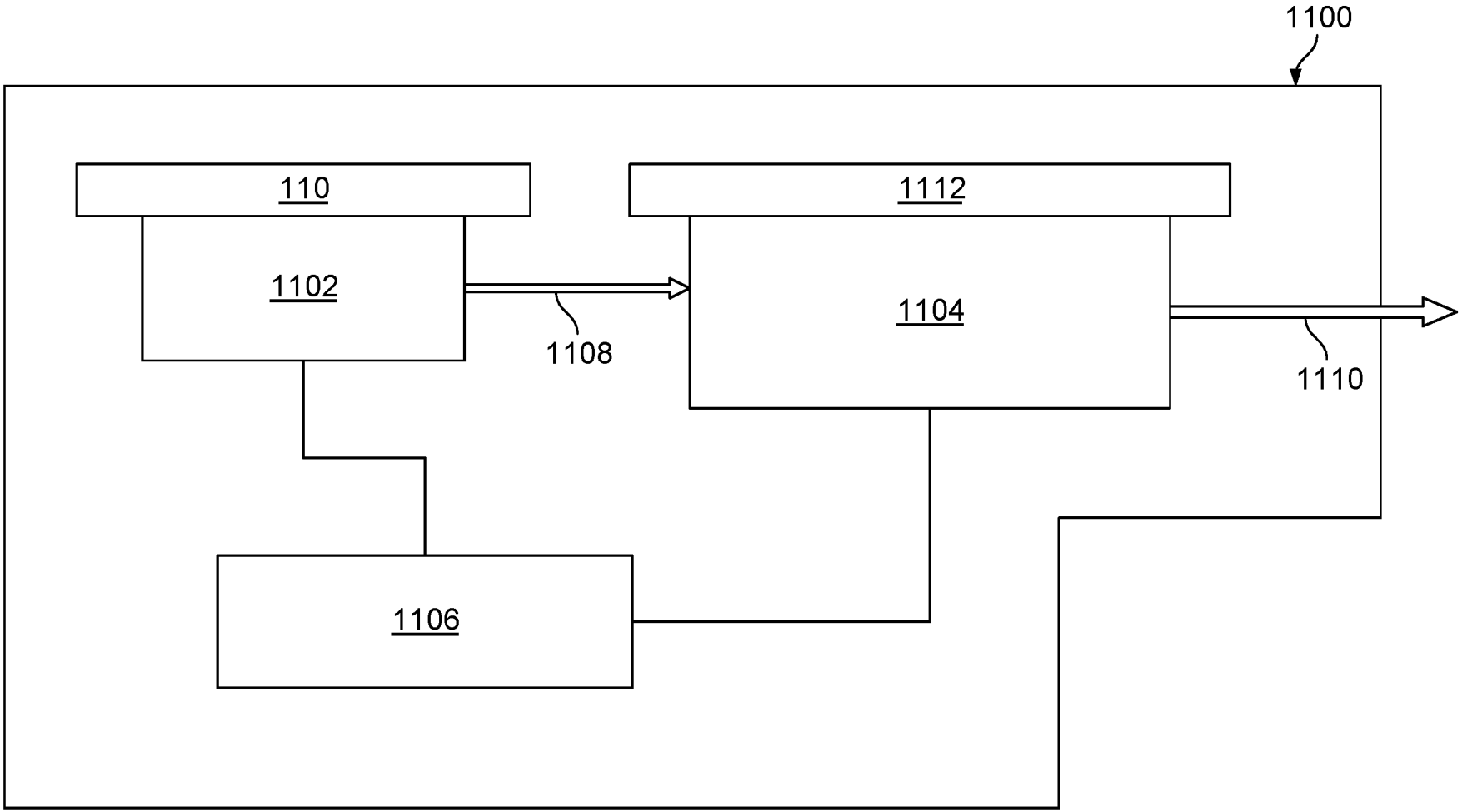
FIG. 11 is a schematic diagram of an example of directed energy system that includes a thermal management system according to the present disclosure.

FIG. 11 shows the control system 999 connected to one or more of the optional sensors discussed above, and configured to receive measurement signals from each of the connected sensors. In many embodiments, however, control system 999 is connected only to certain combinations of the sensors to provide suitable control signals for the first and/or second control device.

Control system 999 can generally be implemented as any one of a variety of different electrical or electronic computing or processing devices, and can perform any combination of the various steps discussed above to control various components of the disclosed thermal management systems.

Control system 999 can generally, and optionally, include any one or more of a processor (or multiple processors) 1102, a memory 1104, a storage device 1106, and input/output device 1108. Some or all of these components can be interconnected using a system bus 1110. The processor is capable of processing instructions for execution. In some embodiments, the processor can be a single-threaded processor. In certain embodiments, the processor can be is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and the sole processor or one of multiple processors of any kind of computer or computing device.

The memory 1104 stores information within the system, and can be a computer-readable medium, such as a volatile or non-volatile memory. The storage device 1106 can be capable of providing mass storage for the control system 999. In general, the storage device 1106 can include any non-transitory tangible media configured to store computer readable instructions. For example, the storage device can include a computer-readable medium and associated components, including: magnetic disks, such as internal hard disks and removable disks; magneto-optical disks; and optical disks. Storage devices 1106 suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein can be supplemented by, or incorporated in, ASICs (application-specific integrated circuits).

The input/output device 1108 provides input/output operations for control system 999, and can include a keyboard and/or pointing device. In some embodiments, the input/output device includes a display unit for displaying graphical user interfaces and system related information. Not shown, but which could be includes is one or more network interfaces.

In addition, control system 999 is optionally connected to expansion valves and second back pressure regulators. In embodiments where either expansion valves or back pressure regulators (or both) is/are implemented as a device controllable via an electrical control signal, control system 999 is configured to transmit suitable control signals to the expansion valves and/or back pressure regulators to adjust the configuration of these components. In particular, control system 999 is optionally configured to adjust expansion valves to control the vapor quality of the refrigerant fluid in system, and optionally configured to adjust back pressure regulators to control the temperature of heat load 112.

During operation of a TMS according to the present disclosure, control system 999 typically receives measurement signals from one or more sensors. The measurements can be received periodically (e.g., at consistent, recurring intervals) or irregularly, depending upon the nature of the measurements and the manner in which the measurement information is used by control system 999. In some embodiments, certain measurements are performed by control system 999 after particular conditions—such as a measured parameter value exceeding or falling below an associated set point value—are reached.

It should generally understood that the systems disclosed herein can include a variety of combinations of the various sensors described above, and control system 999 can receive measurement information periodically or aperiodically from any of the various sensors. Moreover, any of the sensors described can operate autonomously, measuring information and transmitting the information to control system 999 (or directly to the first and/or second control device), or alternatively, any of the sensors described above can measure information when activated by control system 999 via a suitable control signal, and measure and transmit information to control system 999 in response to the activating control signal.

In the embodiment with a single control device, e.g., the expansion valve 108, the expansion valve 108 controls either superheat or heat load temperature or $CO_2$ exhaust temperatures. For example, in some embodiments, expansion valve 108 is adjusted (e.g., automatically or by control system 999) based on a measurement of the evaporation pressure ($p_e$) of the refrigerant fluid and/or a measurement of the evaporation temperature of the refrigerant fluid.

With expansion valve 108 adjusted in this manner, back pressure regulator 114 can be adjusted (e.g., automatically or by control system 999) based on measurements of one or more of the following system parameter values: the pressure drop across expansion valve 108, the pressure drop across evaporator 110, the refrigerant fluid pressure in receiver 104, the vapor quality of the refrigerant fluid emerging from cold plate 110 (or at another location in the system), the superheat value of the refrigerant fluid, and the temperature of heat load 112.

In certain embodiments, expansion valve 108 is adjusted (e.g., automatically or by control system 999) based on a measurement of the temperature of heat load 112. With expansion valve 108 adjusted in this manner, second back pressure regulator 114 can be adjusted (e.g., automatically or by control system 999) based on measurements of one or more of the following system parameter values: the pressure drop across expansion valve 108, the pressure drop across cold plate 110, the refrigerant fluid pressure in receiver 104, the vapor quality of the refrigerant fluid emerging from cold plate 110 (or at another location in the system), the superheat value of the refrigerant fluid, and the evaporation pressure ($p_e$) and/or evaporation temperature of the refrigerant fluid.

In some embodiments, control system 999 controls back pressure regulator 114 based on a measurement of the evaporation pressure $p_e$ of the refrigerant fluid downstream from expansion valve 108 (e.g., measured by sensor(s)) and/or a measurement of the evaporation temperature of the refrigerant fluid (e.g., measured by sensor(s)). With back pressure regulator 114 adjusted based on this measurement, control system 999 can adjust expansion valve 108 based on measurements of one or more of the following system parameter values: the pressure drop ($p_r$–$p_e$) across expansion valve 108, the pressure drop across cold plate 110, the refrigerant fluid pressure in receiver 104 ($p_r$), the vapor quality of the refrigerant fluid emerging from cold plate 110 (or at another location in the system), the superheat value of the refrigerant fluid in the system, and the temperature of heat load 112.

In certain embodiments, control system 999 adjusts back pressure regulator 114 based on a measurement of the temperature of heat load 112 (e.g., measured by sensor(s)). Control system 999 can also adjust expansion valve 108 based on measurements of one or more of the following system parameter values: the pressure drop ($p_r$–$p_e$) across expansion valve 108, the pressure drop across cold plate 110, the refrigerant fluid pressure in receiver 104 ($p_r$), the vapor quality of the refrigerant fluid emerging from cold plate 110 (or at another location in the system), the superheat value of the refrigerant fluid in the system, the evaporation pressure ($p_e$) of the refrigerant fluid, and the evaporation temperature of the refrigerant fluid.

To adjust either expansion valve 108 or back pressure regulator 114 based on a particular value of a measured system parameter value, control system 999 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), control system 999 adjusts expansion valve 108 and/or back pressure regulator 114 to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), control system 999 adjusts expansion valve 108 and/or back pressure regulator 114 to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), control system 999 adjusts expansion valve 108 and/or back pressure regulator 114 to adjust the operating state of the system, so that the system parameter value more closely matches the set point value.

In the foregoing examples, measured parameter values are assessed in relative terms based on set point values (i.e., as a percentage of set point values). Alternatively, in some embodiments, measured parameter values can be asses in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then control system 999 adjusts expansion valve 108 and/or back pressure regulator 114 to adjust the operating state of the system, so that the measured system parameter value more closely matches the set point value. In some embodiments, one or more signals from a heat load can be used to adjust expansion valve 108 and/or back pressure regulator 114.

A control system 999 can optionally be connected to a heat load such as heat load 112, and can receive signals transmitted from heat load 112. Such signals can include, but are not limited to, information about various operating parameters of heat load 112. The information encoded in such signals can correspond, for example, to an operating power of heat load 112, an output energy of heat load 112, an electrical voltage or current within heat load 112, or more generally, any one or more of a wide variety of different operating parameters of the heat load. Control system 999 can then compare the received information to one or more corresponding set point values for the operating parameters of heat load 112, and adjust expansion valve 108 and/or back pressure regulator 114 to alter the operating state of the system based on the one or more operating parameters of heat load 112.

As one example, heat load 112 can transmit to control system 999 a signal that includes information about a total output power of heat load 112 during operation of the heat load. In this example, heat load 112 might correspond, for example, to one or more laser diodes. Control system 999 then use the received information to adjust a flow rate of refrigerant fluid through the system to cool heat load 112 by adjusting expansion valve 108 and/or back pressure regulator 114 accordingly. When the total output power of heat load 112 reaches a maximum value for example, control system 999 may adjust the refrigerant fluid flow rate through the system to a corresponding maximum value, e.g., by fully opening expansion valve 108. In certain embodiments, refrigerant fluid emerging from cold plate 110 can be used to cool one or more additional thermal loads.

Several embodiments have been described. Nevertheless, it will be understood that various modifications may be made without departing from the spirit and scope of the disclosure. Accordingly, other embodiments are within the scope of the following claims.

What is claimed is:

1. A thermal management system, comprising:

a receiver that comprises an inlet and an outlet, the receiver configured to store a refrigerant fluid at a first pressure that is a greater than a critical point pressure of the refrigerant fluid;

at least one flash tank that comprises an inlet fluidly coupled to the outlet of the receiver, a vapor-side outlet, and a liquid-side outlet;

an expansion valve that comprises an inlet fluidly coupled to the liquid-side outlet of the flash tank, the expansion valve configured to expand the refrigerant fluid from the flash tank to a second pressure that is less than a triple point pressure of the refrigerant fluid to form a solid-vapor mixture of the refrigerant fluid;

an evaporator comprising an inlet positioned to receive the solid-vapor mixture of the refrigerant fluid and configured to extract heat from at least one heat load that is in at least one of thermal conductive or convective contact or is in proximity to the evaporator, the evaporator further configured to sublimate a solid state of the solid-vapor mixture of the refrigerant fluid directly into a vapor state of the refrigerant fluid; and an exhaust conduit fluidly coupled to an outlet of the evaporator, the exhaust conduit configured to discharge the vapor state of the refrigerant fluid into an ambient environment without returning the vapor state of the refrigerant fluid from the outlet of the evaporator to the receiver.

2. The system of claim 1, wherein the refrigerant fluid is in a sub-critical or a supercritical phase, and the refrigerant fluid expands in volume below a corresponding triple point and sublimates at an exhaust pressure.

3. The system of claim 1, wherein the refrigerant fluid is carbon dioxide.

4. The system of claim 1, wherein the expansion valve is a mechanically or electronically controllable expansion valve.

5. The system of claim 1, wherein the expansion valve is a fixed or variable orifice.

6. The system of claim 1, wherein the flash tank is configured to reduce a refrigerant fluid enthalpy prior to the inlet to the evaporator to increase a refrigeration effect of the refrigerant fluid in the evaporator.

7. The system of claim 1, wherein the expansion valve is a first expansion valve, the system further comprising:

a second expansion valve that comprises an inlet and an outlet, the inlet fluidly coupled to the outlet of the receiver, the second expansion valve configured to expand the refrigerant fluid from the receiver into a liquid-vapor mixture at a third pressure that is between the first pressure and the second pressure.

8. The system of claim 7, wherein the flash tank is configured to receive the liquid-vapor mixture of the refrigerant fluid and store the liquid-vapor mixture at the third pressure, the system further comprising:

an open-circuit refrigeration system comprised of the receiver, the first and the second expansion valves, the flash tank, the evaporator, and the exhaust conduit.

9. The system of claim 1, further comprising:

a closed-circuit refrigeration system comprised of the flash tank, the closed-circuit refrigeration system configured to receive the refrigerant fluid from the flash tank, the closed-circuit refrigeration system further comprising:

a compressor comprising an inlet and an outlet, the inlet of the compressor fluidly coupled to the vapor-side outlet of the flash tank, the compressor configured to compress refrigerant vapor that exits from the vapor-side outlet of the flash tank.

10. The system of claim 9, wherein the expansion valve is a first expansion valve, the closed-circuit refrigeration system further comprises:

a heat rejection exchanger comprising an inlet and an outlet, the inlet of the heat rejection exchanger fluidly coupled to the outlet of the compressor; and a second expansion valve having an inlet and an outlet, the inlet of the second expansion valve fluidly coupled to the outlet of the heat rejection exchanger, the outlet of the second expansion valve fluidly coupled to the inlet of the flash tank, the second expansion valve configured to expand refrigerant fluid from the heat rejection heat exchanger to a third pressure that is between the first pressure and the second pressure.

11. The system of claim 9, wherein a compressor discharge pressure from the compressor is a trans-critical discharge pressure and the heat rejection exchanger is a gas cooler.

12. The system of claim 9, wherein a compressor discharge pressure from the compressor is a sub-critical discharge pressure and the heat rejection exchanger is a condenser.

13. The system of claim 9, further comprising a recuperative heat exchanger comprising:

a first fluid path that receives the refrigerant fluid from the outlet of the flash tank and delivers the refrigerant fluid to the inlet of the compressor; and a second fluid path that receives refrigerant from the outlet of the heat rejection exchanger and provides expanded refrigerant vapor to the inlet of the flash tank.

14. The system of claim 13, wherein the recuperative heat exchanger is configured to provide thermal contact between the refrigerant vapor leaving the flash tank and refrigerant vapor passed into the recuperative heat exchanger to cause heat from the refrigerant vapor to be transferred to the refrigerant fluid received from the heat rejection exchanger.

15. The system of claim 2, wherein the flash tank is configured to reduce a refrigerant fluid enthalpy prior to the inlet to the evaporator to increase a refrigeration effect of refrigerant fluid in the evaporator.

16. The system of claim 1, further comprising a cooling system configured to cool the refrigerant fluid at the receiver.

17. The system of claim 1, further comprising an external cooling system configured to deliver a coolant in thermal proximity with the refrigerant fluid that leaves the outlet of the receiver.

18. The system of claim 10, wherein the flash tank comprises a first flash tank, the system further comprising:

a second heat rejection exchanger that comprises an inlet and an outlet;

a second flash tank that comprises an inlet, a vapor-side outlet, and a liquid-side outlet, the inlet of the second flash tank configured to receive refrigerant fluid from the outlet of the second expansion valve; and a second compressor that comprises an inlet and an outlet, the inlet of the second compressor fluidly coupled, through a junction, to the vapor-side outlet of the second flash tank, the outlet of the second compressor fluidly coupled to the inlet of the second heat rejection exchanger.

19. The system of claim 18, wherein the outlet of the first heat rejection exchanger is coupled to the inlet of the second heat rejection exchanger through the junction and the second compressor.

20. The system of claim 18, further comprising:

a third expansion valve that comprises an inlet and an outlet; and a recuperative heat exchanger that comprises:

a first fluid path configured to receive the refrigerant fluid from the liquid-side outlet of the first flash tank and deliver the refrigerant fluid to the inlet of the third expansion valve, and a second fluid path configured to receive refrigerant from the vapor-side outlet of the second flash tank and provide the refrigerant vapor to the inlet of the second compressor.

21. The system of claim 20, further comprising a fourth expansion valve that comprises an inlet and an outlet, the inlet of the fourth expansion valve fluidly coupled to the outlet of the receiver, the outlet of the fourth expansion valve fluidly coupled to the inlet of the first flash tank.

22. A thermal management method, comprising:

transporting a refrigerant fluid from a receiver to an inlet of a flash tank that has a vapor-side outlet and liquid-side outlet such that a liquid phase of the refrigerant fluid moves to a bottom of the flash tank and outputs from the liquid-side outlet;

forming a solid-vapor state from the liquid phase by expanding the liquid phase from the liquid-side outlet with an expansion valve to a first pressure that is less than a triple point pressure of the refrigerant fluid to form a solid-vapor mixture of the refrigerant fluid;

extracting heat from a heat load in at least one of thermal conductive or convective contact or in proximity to an evaporator that receives the solid-vapor mixture of the refrigerant fluid and sublimates the solid state of the solid-vapor mixture of the refrigerant fluid directly into a vapor phase of the refrigerant fluid; and discharging, from an exhaust line fluidly coupled to an outlet of the evaporator, the vapor phase to an ambient environment without returning the vapor phase to the receiver.

23. The method of claim 22, wherein the refrigerant fluid is in a sub-critical or a supercritical phase, and the refrigerant fluid expands in volume below the triple point pressure of the refrigerant fluid and sublimates at an exhaust pressure.

24. The method of claim 22, wherein the refrigerant fluid is carbon dioxide.

25. The method of claim 22, wherein the expansion device is a mechanically or electronically controllable expansion valve.

26. The method of claim 22, wherein the expansion device is a fixed or variable orifice.

27. The method of claim 22, further comprising reducing, with the flash tank, a refrigerant fluid enthalpy prior to the inlet to the evaporator to increase a refrigeration effect of refrigerant fluid in the evaporator.

28. The method of claim 22, wherein the expansion valve is a first expansion valve, the method further comprising:

expanding the refrigerant fluid from the receiver into a liquid-vapor mixture to a third pressure that is between the first pressure and the second pressure with a second expansion valve that comprises an inlet and an outlet, the inlet of the second expansion valve fluidly coupled to the outlet of the receiver.

29. The method of claim 28, wherein the flash tank receives the liquid-vapor mixture of the refrigerant fluid and stores the liquid-vapor mixture at the third pressure, the receiver, the first and the second expansion valves, the flash tank, the evaporator, and the exhaust conduit fluidly coupled to form an open-circuit refrigeration system, the method further comprising:

discharging refrigerant vapor from the exhaust conduit to the ambient environment without returning the discharged refrigerant vapor to the receiver.

30. The method of claim 22, further comprising:

receiving refrigerant fluid in a closed-circuit refrigeration system from the flash tank; and compressing vapor from the vapor-side outlet of the flash tank by a compressor having an inlet and an outlet, with the inlet of the compressor fluidly coupled to the vapor-side outlet of the flash tank.

31. The method of claim 30, wherein the expansion valve is a first expansion valve, the method further comprising:

rejecting heat to the ambient environment with a heat rejection exchanger that comprises an inlet and an outlet, the inlet of the heat rejection exchanger fluidly coupled to the outlet of the compressor; and expanding refrigerant fluid from the flash tank to a third pressure that is between the first pressure and the second pressure by a second expansion valve that comprises an inlet and an outlet, the inlet of the second expansion valve fluidly coupled to the outlet of the heat rejection exchanger, the outlet of the second expansion valve fluidly coupled to the inlet of the flash tank.

32. The method of claim 31, wherein a compressor discharge pressure from the compressor is a trans-critical discharge pressure, and the heat rejection exchanger is a gas cooler.

33. The method of claim 31, wherein a compressor discharge pressure from the compressor is a sub-critical discharge pressure, and the heat rejection exchanger is a condenser.

34. The method of claim 31, further comprising:

causing heat from the refrigerant vapor to be transferred to the refrigerant fluid received from the heat rejection exchanger by a recuperative heat exchanger that has a first fluid path that receives the refrigerant fluid from the outlet of the flash tank and delivers the refrigerant to the inlet of the compressor, and a second fluid path that receives refrigerant from the outlet of the heat rejection exchanger and provides expanded refrigerant vapor into the flash tank.

* * * * *